US012270591B2

(12) United States Patent
Kim et al.

(10) Patent No.: US 12,270,591 B2
(45) Date of Patent: Apr. 8, 2025

(54) REFRIGERATOR

(71) Applicant: LG Electronics Inc., Seoul (KR)

(72) Inventors: Ki Hwang Kim, Seoul (KR); Sung Hee Kang, Seoul (KR); Dong Hwi Kim, Seoul (KR); Yong Hyeon Cho, Seoul (KR); Jong Pil Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 245 days.

(21) Appl. No.: 17/917,695

(22) PCT Filed: Sep. 25, 2020

(86) PCT No.: PCT/KR2020/013149

§ 371 (c)(1),
(2) Date: Oct. 7, 2022

(87) PCT Pub. No.: WO2021/206241

PCT Pub. Date: Oct. 14, 2021

(65) Prior Publication Data

US 2023/0152026 A1 May 18, 2023

(30) Foreign Application Priority Data

Apr. 8, 2020 (KR) ..... 10-2020-0042531

(51) Int. Cl.
*F25D 17/06* (2006.01)

(52) U.S. Cl.
CPC ..... *F25D 17/065* (2013.01); *F25D 2317/063* (2013.01); *F25D 2317/067* (2013.01); *F25D 2317/0682* (2013.01)

(58) Field of Classification Search
CPC ..... F25D 17/065; F25D 2317/063; F25D 2317/067; F25D 2317/0682; F25D 2317/0683; F25D 2323/00281; F25D 17/08; F25D 17/045; F25D 23/12; F25D 2317/061; F25D 2317/0661; F25D 2317/0672; F25D 2317/0681
See application file for complete search history.

(56) References Cited

U.S. PATENT DOCUMENTS

2009/0113924 A1* 5/2009 Bae ..... F25D 17/065 29/890.035

FOREIGN PATENT DOCUMENTS

KR 20070000977 A * 1/2007

* cited by examiner

*Primary Examiner* — Kun Kai Ma
(74) *Attorney, Agent, or Firm* — Fish & Richardson P.C.

(57) ABSTRACT

A refrigerator is configured to supply cool air to a refrigerating compartment, a freezing compartment, and an ice-making compartment by a single evaporator. A cool air passage for the ice-making compartment for supplying cool air to the ice-making compartment is configured to supply the cool air to an upper space in a cool air passage for the freezing compartment, which supplies cool air to the refrigerating compartment and the freezing compartment, through an upper supply passage. Accordingly, since additional cool air is supplied to the cool air passage for the freezing compartment by using the upper supply passage, sufficient cool air is supplied to the refrigerating compartment and the freezing compartment by the single evaporator.

18 Claims, 28 Drawing Sheets

REFRIGERATOR

CROSS-REFERENCE TO RELATED APPLICATIONS

This application is a National Stage application under 35 U.S.C. § 371 of International Application No. PCT/KR2020/013149, filed on Sep. 25, 2020, which claims the benefit of Korean Patent Application No. 10-2020-0042531, filed on Apr. 8, 2020. The disclosures of the prior applications are incorporated by reference in their entirety.

TECHNICAL FIELD

The present disclosure relates to a refrigerator having a refrigerating compartment and a freezing compartment that respectively provide storage spaces and having an ice-making compartment provided in a refrigerating compartment door

BACKGROUND ART

Generally, a refrigerator is a home appliance that is provided to store various foods or beverages for a long time by cool air generated by circulation of a refrigerant according to a refrigeration cycle.

The refrigerator is configured of one or a plurality of partitioned storage compartments for cooling an object to be stored. Each of the storage compartments may be opened or closed by a rotary type door, or may be ejected and retracted or store in a drawer manner.

In particular, the storage compartments may include a freezing compartment for freezing the object to be stored and a refrigerating compartment for refrigerating the object to be stored. In addition, the storage compartments may include at least two freezing compartments or at least two refrigerating compartments.

In recent refrigerators, an ice-making compartment is provided in a refrigerating compartment door so that a user can take out ice without opening the freezing compartment.

That is, cool air has passed through an evaporator in a cabinet is delivered to the refrigerating compartment door through a cool air duct for the ice-making compartment, and when the refrigerating compartment door is closed, the cool air is supplied to the ice-making compartment through a connection passage provided in the refrigerating compartment door by the cool air duct for the ice-making compartment.

The above refrigerator is proposed in various related art, such as Korean Patent No. 10-1639443, Korean Patent Application Publication No. 10-2009-0101525, and Korean Patent No. 10-1659622.

However, in the related art, a grille fan assembly located in a freezing compartment and supplying cool air to the freezing compartment and an ice-making fan module supplying cool air to an ice-making compartment are provided separately from each other and then coupled to each other, so that there is inconvenience of assembling.

That is, since a fan duct for guiding cool air to a cool air duct for the ice-making compartment is additionally provided in the ice-making fan module, there is a problem in the process of installing the ice-making fan module in the grille fan assembly because the fan duct may not precisely match with the cool air duct for the ice-making compartment. Therefore, the attention of an operator is required for matching between the fan duct and the cool air duct for the ice-making compartment.

The refrigerator which has the ice-making compartment in the refrigerating compartment door is configured to selectively supply cool air to the refrigerating compartment, the freezing compartment, and the ice-making compartment by using a single evaporator.

However, the refrigerator according to the related art is configured to supply cool air to three spaces by the single evaporator. Therefore, in the refrigerator, the sufficient supply of cool air to the freezing compartment is not performed.

In particular, since the freezing compartment has a larger space than the ice-making compartment, sufficient cool air should be supplied to the freezing compartment compared to the ice-making compartment. However, the freezing compartment according to the related art has a disadvantage in that sufficient cool air is not provided thereto.

In the refrigerator according to the related art, during the freezing operation in which cool air is supplied to the freezing compartment, a large amount of condensed water occurs due to humid air which flows back through the cool air duct for the ice-making compartment from the refrigerating compartment. In this case, there may be a concern of the malfunction of the ice-making fan due to the freezing of the condensed water.

Conventionally, various efforts have been carried out for removing condensed water or for preventing the freezing of the condensed water in a portion where the ice-making fan module is located.

However, despite the above efforts, a structure that prevents the back flow of cool air from the cool air duct for the ice-making compartment or a structure for quickly removing the condensed water flowing into the ice-making fan module is not provided in the refrigerator, so the above problems still remain.

DISCLOSURE

Technical Problem

Accordingly, the present disclosure has been made keeping in mind the above problems occurring in the prior art, and an objective of the present disclosure is to provide a refrigerator. Wherein part of cool air supplied through a cool air passage for an ice-making compartment is supplied to a freezing compartment through a cool air passage for a freezing compartment when an ice-making fan and a freezing fan are operated at the same time. Whereby, freezing operation for the freezing compartment may be smoothly performed by a single evaporator.

Another objective of the present disclosure is to provide a refrigerator. Wherein a cool air passage for a refrigerating compartment guiding cool air to the freezing compartment and the cool air passage for the ice-making compartment guiding cool air flow to the ice-making compartment partially share the cool air with each other. Whereby, even when only the ice-making fan is operated, cool air in the freezing compartment may be prevented from flowing back to the cool air passage for the ice-making compartment.

A further objective of the present disclosure is to provide a refrigerator capable of minimizing the interference in which of part of the cool air supplied to the cool air passage for the freezing compartment by the ice-making fan interferes with the flow of cool air flowing in the cool air passage for the freezing compartment by the freezing fan.

A further objective of the present disclosure is to provide a refrigerator in which a condensed water discharge structure is provided in a portion where an ice-making fan module is located. Accordingly, even when condensed water occurs around the ice-making fan module, the ice-making fan module is prevented from freezing.

Technical Solution

In the refrigerator of the present disclosure in order to achieve the above objectives, a refrigerator of the present disclosure may include an upper supply passage. Therefore, part of cool air flowing in a cool air passage for an ice-making compartment may be supplied to an upper space in a cool air passage for a freezing compartment.

In the refrigerator of the present disclosure, the cool air passage for the freezing compartment and the cool air passage for the ice-making compartment may be formed at at least one of facing surfaces between a grille panel and a shroud. Therefore, compared to the conventional art in which a duct for an ice-making fan is separately provide and coupled to the shroud, the refrigerator of the present disclosure may have a simple structure and there is not inconvenience of assembling or malfunction.

In the refrigerator of the present disclosure, a refrigerating compartment side grille fan assembly may be configured to receive cool air from a freezing compartment side grille fan assembly through a connection passage. Therefore, the refrigerating compartment, the freezing compartment, and the ice-making compartment may be cooled by a single evaporator.

In the refrigerator of the present disclosure, a cool air outlet may be located directly above a freezing fan of an upper surface of the freezing compartment side grille fan assembly. Therefore, cool air may be sufficiently supplied to the refrigerating compartment side grille fan assembly.

The refrigerator of the present disclosure may include a passage opening and closing module cool air of the cool air passage for the freezing compartment supplied to the refrigerating compartment side grille fan assembly through the connection passage. Therefore, the refrigerating operation and the freezing operating may be separately performed by the single evaporator.

The refrigerator of the present disclosure may be configured such that the freezing fan is configured as a type of fan providing a larger amount of air than the ice-making fan. Therefore, by the operation of the freezing fan, cool air may be sufficiently supplied to the refrigerating compartment.

In the refrigerator of the present disclosure, the freezing fan may be located at a center portion of the freezing compartment side grille fan assembly and the ice-making fan is located on one side of the freezing fan. Therefore, cool air may be evenly supplied to the entire portion in the freezing compartment through each cool air outlet of the freezing compartment side grille fan assembly, and the cool air may be sufficiently supplied to the ice-making.

In the refrigerator of the present disclosure, the cool air passage for the ice-making compartment may be configured to penetrate a wall surface of the freezing compartment side grille fan assembly, the wall surface being positioned in a side close to the ice-making fan in opposite sides of the freezing compartment side grille fan assembly based on the freezing fan. Therefore, a cool air duct for the ice-making compartment may be formed to be shorter.

The refrigerator of the present disclosure may include a passage rib. Therefore, the cool air passage for the freezing compartment and the cool air passage for the ice-making compartment may be divided from each other by the passage rib.

In the refrigerator of the present disclosure, the passage rib may include a first circumferential passage rib surrounding an upper circumference of the ice-making fan module and a second circumferential passage rib surrounding a lower circumference of the ice-making fan module. Therefore, the cool air passage for the ice-making compartment may be formed by the two circumferential passage ribs.

In the refrigerator of the present disclosure, L the first circumferential passage rib and the second circumferential passage rib may be configured to be spaced apart from each other. Therefore, the upper supply passage may be formed in a space between the two circumferential passage ribs and be configured to be open vertically.

In the refrigerator of the present disclosure, an upper end of the second circumferential passage rib may be located to be higher than center height of the freezing fan. Therefore, cool air blown in a radial direction of the freezing fan by the operation of the freezing fan may be prevented from flowing back into the upper supply passage through the upper supply passage and interfering with the cool air discharge.

In the refrigerator of the present disclosure, an open upper portion of the upper supply passage may be configured to face the freezing compartment side cool air outlet. Therefore, cool air supplied to the cool air passage for the freezing compartment through the upper supply passage may not interfere with the flow of cool air flowing in the cool air passage for the freezing compartment.

In the refrigerator of the present disclosure, an upper end of the second circumferential passage rib may be inclined or rounded to be gradually close to the freezing fan, as the second circumferential passage rib goes to the upper end thereof. Therefore, the cool air blown while rotating along an upper circumference of the freezing fan may be sufficiently supplied to cool air outlets located at opposite sides of an upper portion of the freezing fan.

In the refrigerator of the present disclosure, the freezing compartment side grille fan assembly may include a lower supply passage. Therefore, part of cool air flowing along the cool air passage for the ice-making compartment may be supplied to another freezing compartment side cool air outlet that is located to communicate with a lower space in the cool air passage for the freezing compartment.

In the refrigerator of the present disclosure, the cool air passage for the freezing compartment and the cool air passage for the ice-making compartment may be formed by recessing a rear surface of the grille panel, the lower supply passage may be configured to discharge cool air to either wall surface of the rear surface of the grille panel. Therefore, the cool air in the cool air passage for the ice-making compartment discharged to the cool air passage for the freezing compartment through the lower supply passage may be prevented from interfering with the cool air flow in the cool air passage for the freezing compartment.

In the refrigerator of the present disclosure, the shroud may have a drainage hole. Therefore, condensed water flowing through the lower supply passage may be smoothly discharged to the outside of the freezing compartment side grille fan assembly.

The cabinet may include a recovery duct for the refrigerating compartment, the recovery duct being configured to recover the cool air in the refrigerating compartment to the evaporator. Therefore, the load of the evaporator may be reduced.

Advantageous Effects

As described above, the refrigerator of the present disclosure provides part of cool air in the cool air passage for the ice-making compartment to the cool air passage for the freezing compartment by the provision of the supply passage. Accordingly, although the single evaporator is provided, even when the freezing fan and the ice-making fan are operated at the same time, sufficient cool air can be supplied to the freezing compartment, and when only the ice-making fan is operated, cool air can be prevented from flowing back from the freezing compartment.

Further, the refrigerator of the present disclosure is configured such that the supply passage directly faces an auxiliary cool air outlet. Accordingly, there is an effect that the cool air supplied from the cool air passage for the ice-making compartment through the supply passage cannot interfere with the flow of cool air flowing in the cool air passage for the freezing compartment.

Further, in the refrigerator of the present disclosure, the lower supply passage is provided in a lower surface (second circumferential passage rib) of an installation portion of the ice-making fan module. Accordingly, there is an effect that sufficient cool air can be supplied to the lower space in the freezing compartment and the condensed water can be discharged through the lower supply passage to prevent the freezing of the ice-making fan.

The refrigerator of the present disclosure is configured to supply cool air to the cool air passage for the refrigerating compartment of the refrigerating compartment side grille fan assembly through the cool air outlet formed in an upper wall surface of the cool air passage for the freezing compartment and the connection passage connected to the cool air outlet. Accordingly, there is an effect that the single evaporator can selectively supply cool air to the refrigerating compartment, the freezing compartment, and the ice-making compartment.

MODE FOR INVENTION

Hereinbelow, an exemplary embodiment with respect to a refrigerator of the present disclosure will be described in detail with reference to accompanying FIGS. 1 to 35.

Figure 1:
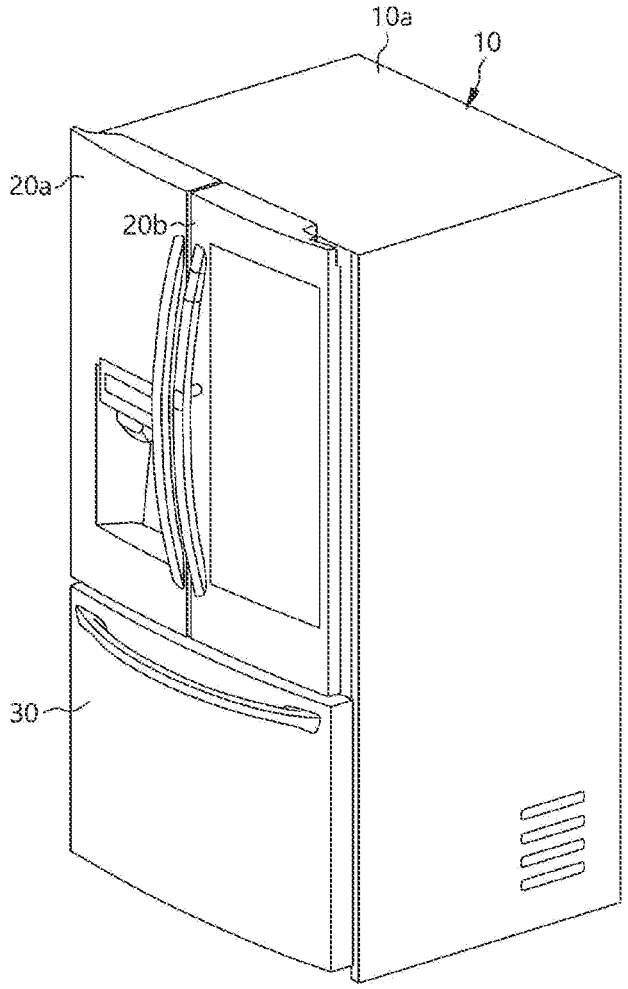
FIG. 1 is a perspective view showing an external structure of a refrigerator according to an embodiment of the present disclosure.
Figure 2:
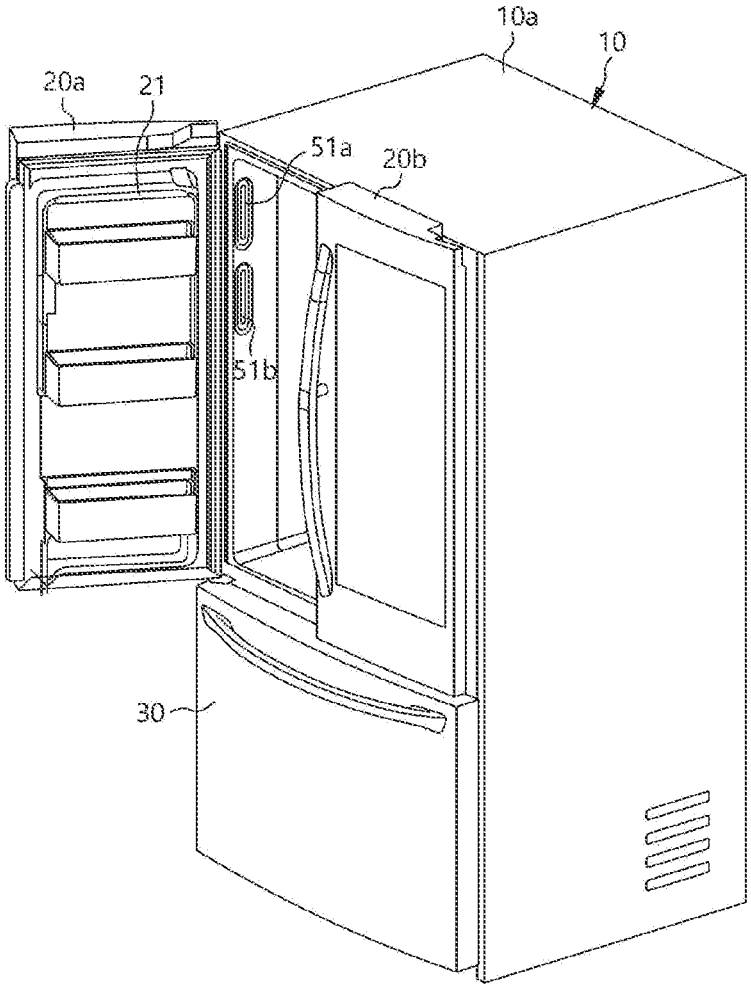
FIG. 2 is a perspective view showing a state in which a refrigerating compartment door with an ice-making compartment of the refrigerator according to the embodiment of the present disclosure is opened.
Figure 3:
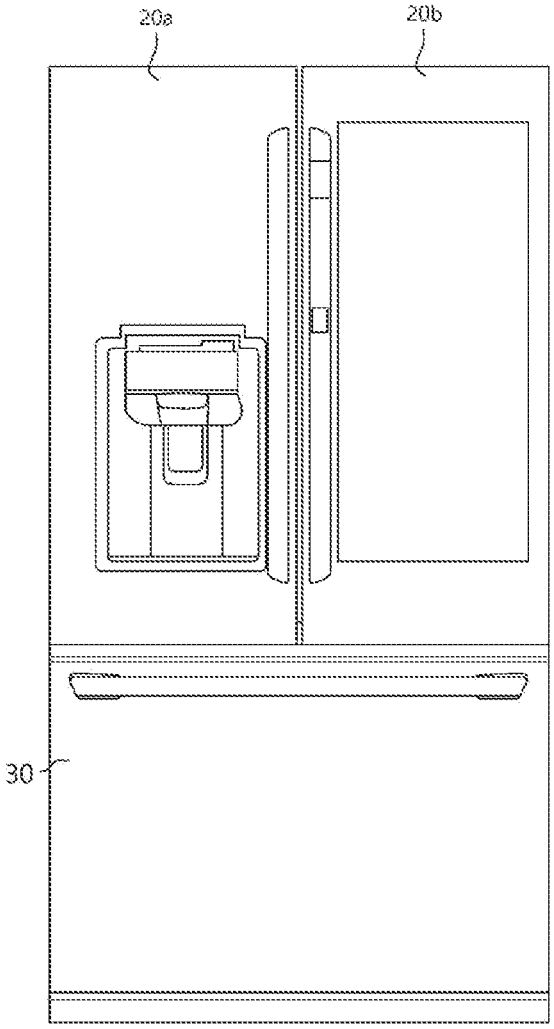
FIG. 3 is a front view schematically showing an inner structure of the refrigerator according to the embodiment of the present disclosure.

FIG. 1 is a perspective view showing an external structure of a refrigerator according to an embodiment of the present disclosure. FIG. 2 is a perspective view schematically showing an inner structure of the refrigerator according to the embodiment of the present disclosure. FIG. 3 is a front view schematically showing an inner structure of the refrigerator according to the embodiment of the present disclosure.

Figure 4:
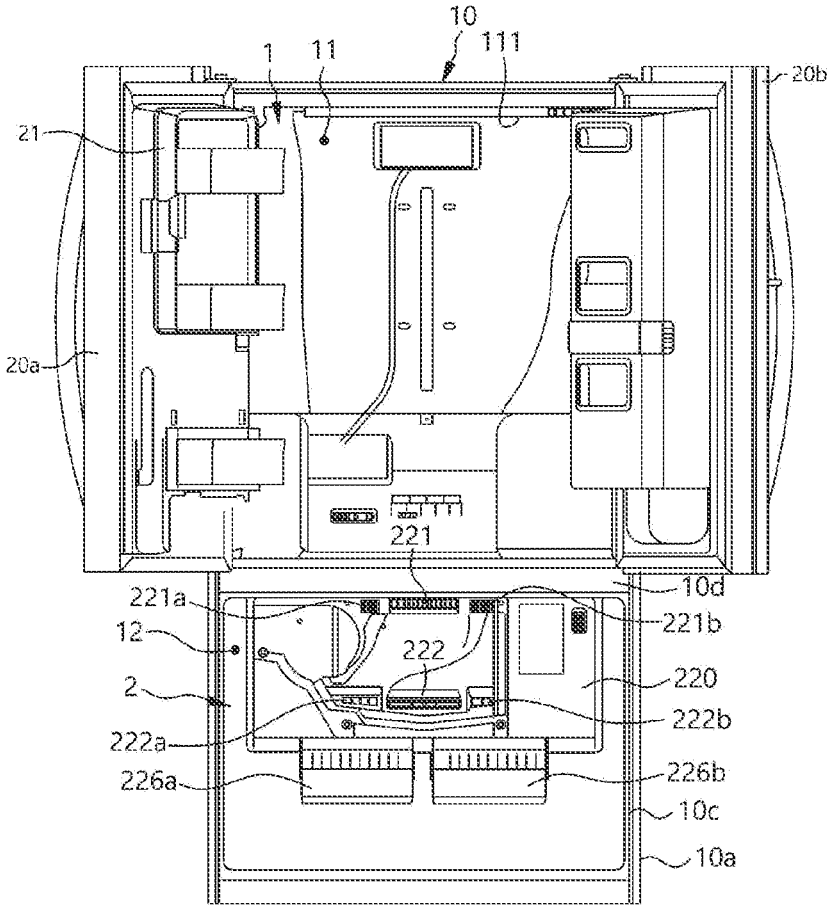
FIG. 4 is a front view showing a state in which two refrigerating compartment doors and two freezing compartment doors are opened for showing the inner structure of the refrigerator according to the embodiment of the present disclosure.
Figure 5:
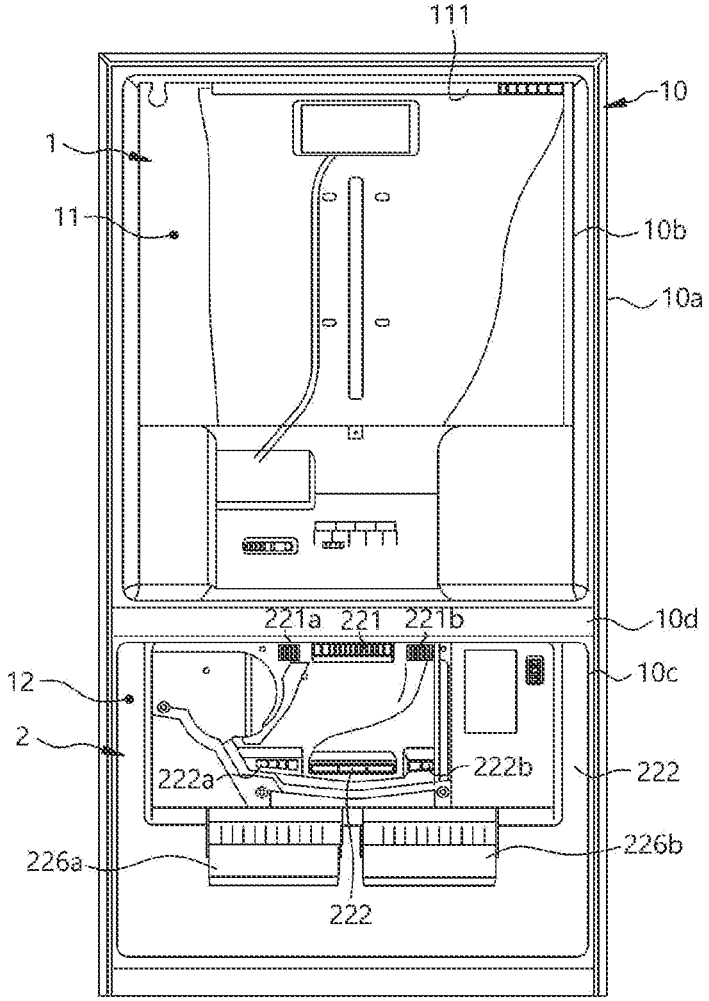
FIG. 5 is a front view showing the state in which two refrigerating compartment doors and two freezing compartment doors are omitted for showing the inner structure of the refrigerator according to the embodiment of the present disclosure.
Figure 6:
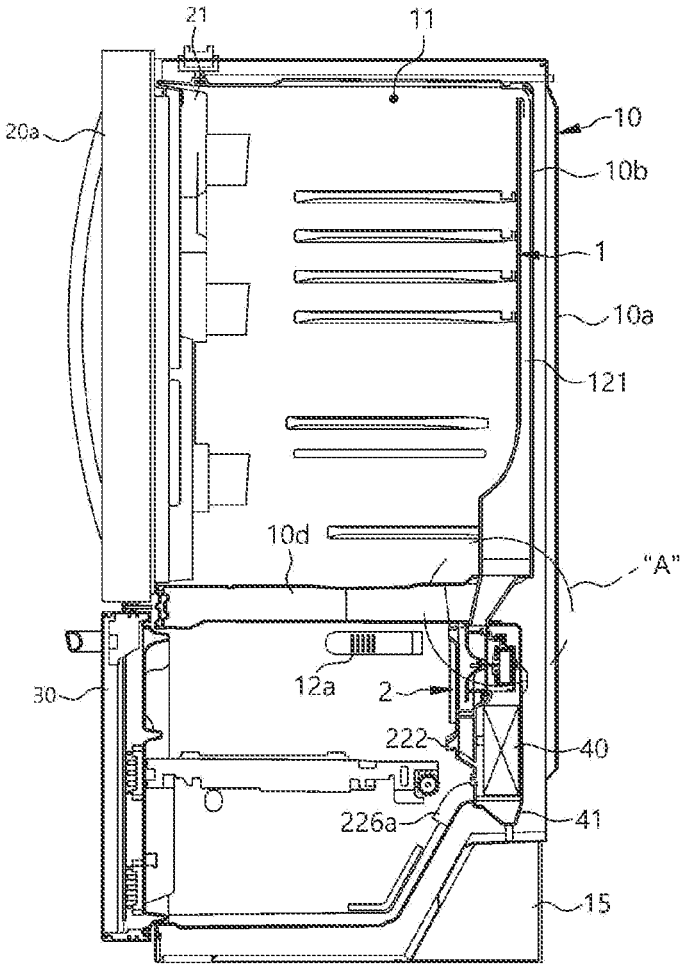
FIG. 6 is a side section view showing the inner structure of the refrigerator according to the embodiment of the present disclosure.
Figure 7:
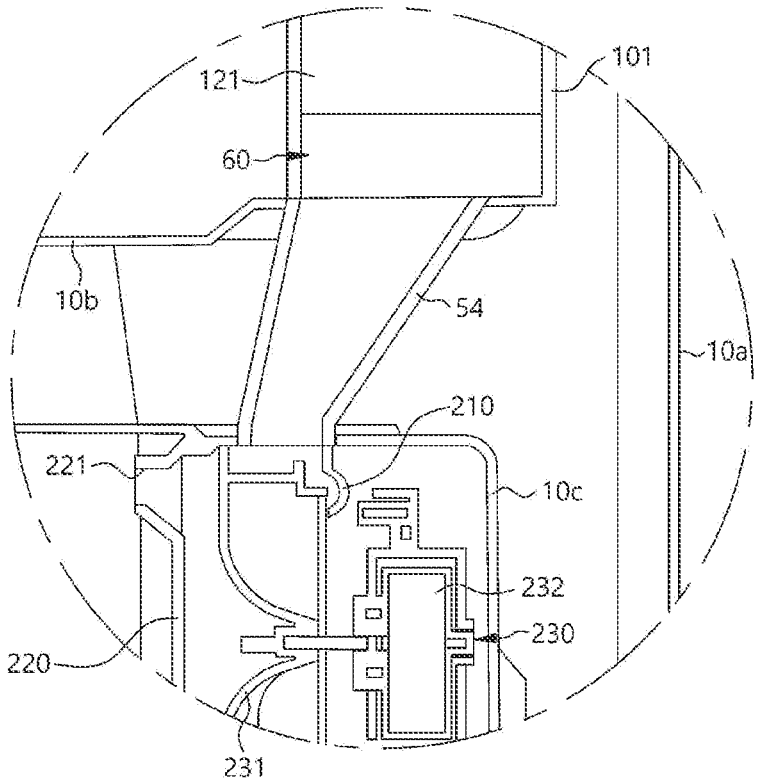
FIG. 7 is an enlarged view of part A in FIG. 6.

FIG. 4 is a front view showing a state in which two refrigerating compartment doors and two freezing compartment doors are opened for showing the inner structure of the refrigerator according to the embodiment of the present disclosure. FIG. 5 is a front view showing the state in which the two refrigerating compartment doors and the two freezing compartment doors are omitted for showing the inner structure of the refrigerator according to the embodiment of the present disclosure.

As shown in the drawings, the refrigerator according to the embodiment of the present disclosure includes a cabinet 10 having a refrigerating compartment 11 and a freezing compartment 12, and a refrigerating compartment door 20*a* having an ice-making compartment 21. The refrigerating compartment 11 is configured to receive cool air from a refrigerating compartment side grille fan assembly 1.

The ice-making compartment 21 is configured to be. located in any one refrigerating compartment door 20*a* and to receive cool air from a freezing compartment side grille fan assembly 2 together with the freezing compartment 12.

In addition, the cool air is generated from a single evaporator 40 and then supplied into the refrigerating compartment 11, the freezing compartment 12, and the ice-making compartment 21 through the refrigerating compartment side grille fan assembly 1 and the freezing compartment side grille fan assembly 2. The freezing compartment side grille fan assembly 2 is configured such that a cool air passage 224 for the freezing compartment and a cool air passage 223 for the ice-making compartment are integrally formed and the cool air passage 223 for the ice-making compartment shares cool air thereof with the cool air passage 224 for the freezing compartment a supply passage 215*a*, 215*b*.

That is, as the cool air passage 224 for the freezing compartment and the cool air passage 223 for the ice-making compartment share the cool air with each other, the cool air may be selectively supplied from the single evaporator 40 to the refrigerating compartment 11, the freezing compartment 12, and the ice-making compartment 21. Further, as the cool air supplied to the ice-making compartment 21 may be partially supplied to the freezing compartment 12, enough cool air may be supplied to the freezing compartment 12.

The refrigerator according to the embodiment of the present disclosure will be described in detail as follows.

First, the refrigerating compartment 11 is a storage compartment provided to refrigerate an object to be stored, and the freezing compartment 12 is a storage compartment provided to freeze the object to be stored.

The refrigerating compartment 11 is provided in an upper space in the cabinet 10, and the freezing compartment 12 is provided in a lower space in the cabinet 10.

The cabinet 10 may consist of an outer casing 10*a* forming an external surface of the refrigerator and two inner casings 10*b* and 10*c* forming an inner surface of the refrigerator.

In the two inner casings 10*b* and 10*c*, an upper inner casing 10*b* (Hereinbelow, upper inner casing refers to "inner casing for refrigerating compartment") is a portion providing the refrigerating compartment 11, and a lower inner casing 10*c* (Hereinbelow, lower inner casing refers to "inner casing for freezing compartment") is a portion providing the freezing compartment 12.

That is, an inside space of the inner casing 10*b* for the refrigerating compartment is used as the refrigerating compartment 11, and an inside space of the inner casing 10*c* for the freezing compartment is used as the freezing compartment 12.

The inner casing 10*b* for the refrigerating compartment and the inner casing 10*c* for the freezing compartment are formed in a box shape with an open front surface, and are formed to be spaced apart from each other.

A partition wall 10*d* (referring to FIGS. 4 and 6) may be provided in a space between the two inner casings 10*b* and 10*c*. The partition wall 10*d* may be a separate frame placed between the two inner casings 10*b* and 10*c*, may be a filling material filling between the two inner casings 10*b* and 10*c*, or may be configured as a void.

Further, the refrigerating compartment 11 is configured to be opened and closed by a refrigerating compartment door 20*a*, 20*b*, and the freezing compartment 12 is configured to be opened and closed by a freezing compartment door 30.

The refrigerating compartment door 20*a*, 20*b* is configured as two doors, and configured as double-door type rotary doors (a door installed to be horizontally rotatable) that may respectively open and close opposite sides of the refrigerating compartment 11.

The freezing compartment door 30 is configured as a drawer that is ejected and retracted from the freezing compartment 12 in a sliding manner.

In particular, the ice-making compartment 21 is provided at the inside (a side located in the refrigerating compartment when the refrigerating compartment door is closed) of either refrigerating compartment door 20*a* (Hereinbelow, the door refers to a "first refrigerating compartment door") of the two refrigerating compartment doors 20*a* and 20*b*. The ice-making compartment 21 is a storage compartment having an ice tray (not shown) for making ice at the first refrigerating compartment door 20*a*. The ice-making compartment 21 is configured to have a space partitioned from the refrigerating compartment 11. The first refrigerating compartment door 20*a* is a refrigerating compartment door located on the left side when the refrigerator is viewed from the front.

Although not shown in the drawings, the ice-making compartment 21 may be additionally provided in another refrigerating compartment door 20*b* (a refrigerating compartment door is located on the right side when the refrigerator is viewed from the front. Hereinbelow, the refrigerating compartment door refers to "second refrigerating compartment door") of the refrigerating compartment doors 20*a* and 20*b*. The ice-making compartment 21 may be configured to be provide in only the second refrigerating compartment door 20*b*.

Further, the evaporator 40 is provided in the cabinet 10.

The evaporator 40 may be located in the rear side (the rear side in the freezing compartment) in the inner casing 10*c* for the freezing compartment. In more detail, the evaporator 40 may be located above a machine room 15.

The machine room 15 is provided in a rear side of a lower portion of the inner casing 10*c* for the freezing compartment and provides a space in which a compressor and a condenser are installed.

The lower rear portion in the freezing compartment 12 has a freezing space that is narrower than an upper rear portion in the freezing compartment 12 by the size of the machine room 15. That is, the upper portion in the freezing compartment 12 is formed by protruding rearward more than the lower portion in the freezing compartment 12, and the evaporator 40 is located in the upper rear portion in the freezing compartment 12.

Further, a recovery duct 53 for the refrigerating compartment is provided in the cabinet 10.

The recovery duct 53 for the refrigerating compartment is provided to recover the cool air flowing in the refrigerating compartment 11 toward a cool air inlet side of the evaporator 40.

A first end of the recovery duct 53 for the refrigerating compartment is configured to be connected to a lower end of a rear surface of the inner casing 10*b* for the refrigerating compartment constituting the cabinet 10. A second end of the recovery duct 53 for the refrigerating compartment is configured to be connected to the cool air inlet side (a lower portion of the evaporator) of the evaporator 40 of a rear surface of the inner casing 10*c* for the freezing compartment constituting the cabinet 10.

The first end of the recovery duct 53 for the refrigerating compartment is configured to be connected to a side portion of a connection passage 54. The connection passage 54 has a structure having a passage therein for supplying cool air generated in the freezing compartment side grille fan assembly 2 to the refrigerating compartment side grille fan assembly 1.

Although not shown in the drawings, the connection passage 54 may be formed in a hollow tube body (duct) and formed of a soft material such as a hose.

The connection passage 54 may be provided in the refrigerating compartment side grille fan assembly 1 or in the freezing compartment side grille fan assembly 2.

In the embodiment of the present disclosure, the connection passage 54 may be configured to be formed separately from the cabinet 10 and the two grille fan assemblies 1 and 2 and then to be connected to the two grille fan assemblies 1 and 2.

Further, the freezing compartment side grille fan assembly 2 is provided in front of the evaporator 40.

The freezing compartment side grille fan assembly 2 is configured to selectively supply cool air to the freezing compartment 12 and the ice-making compartment 21 while two fan modules 230 and 240 are simultaneously installed therein.

That is, the two fan modules 230 and 240 are simultaneously provided in the single freezing compartment side grille fan assembly 2, and a structure for guiding a flow of cool air blown by the two fan modules 230 and 240 is integrally formed in the freezing compartment side grille fan assembly 2.

Further, a cool air duct 51 for the ice-making compartment is provided in a gap between the outer casing 10*a* and any one side wall of the inner casing 10*b*, 10*c* constituting the cabinet 10.

The cool air duct 51 for the ice-making compartment is a duct that guides cool air provided from the freezing compartment side grille fan assembly 2 to be supplied to the ice-making compartment 21.

Figure 10:
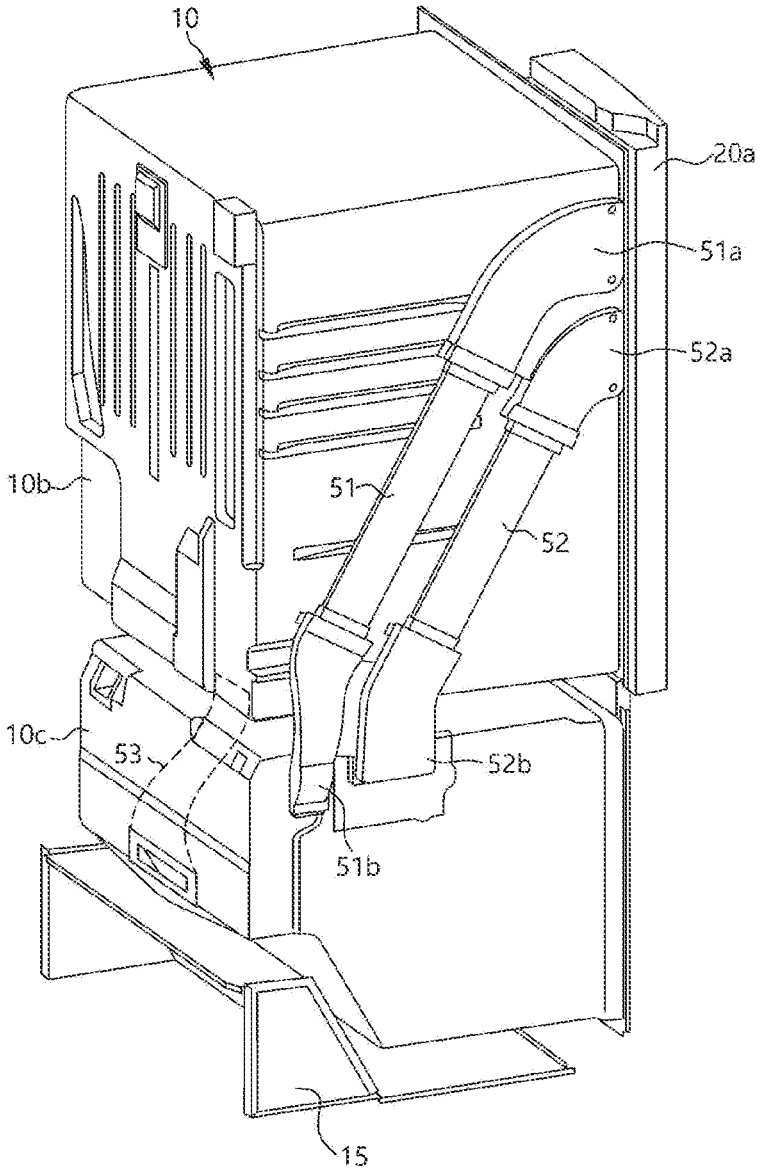
FIG. 10 is a perspective view viewed from a rear surface of the refrigerator, the view showing a state in which an outer casing is removed for showing an installation structure of a cool air duct for the ice-making compartment, the recovery duct for the ice-making compartment, a connection passage, and a recovery duct for a refrigerating compartment.
Figure 11:
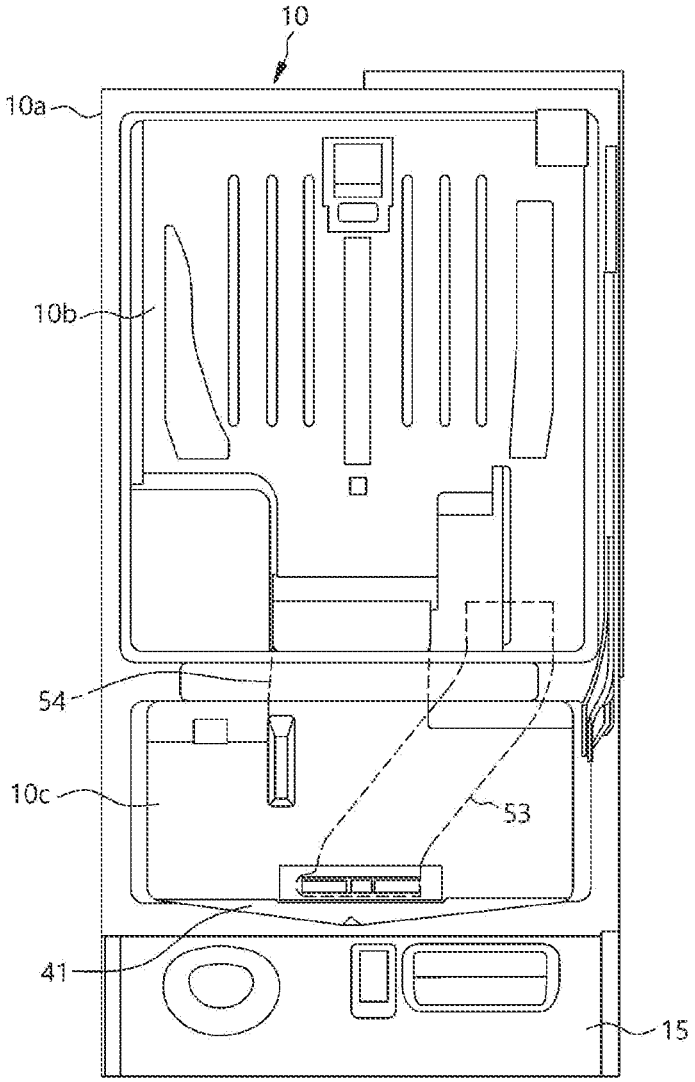
FIG. 11 is a rear view showing the refrigerator according to the embodiment of the present disclosure in a state in which the outer casing is removed for showing an installation structure of the connection passage and the recovery duct for the refrigerating compartment.
Figure 12:
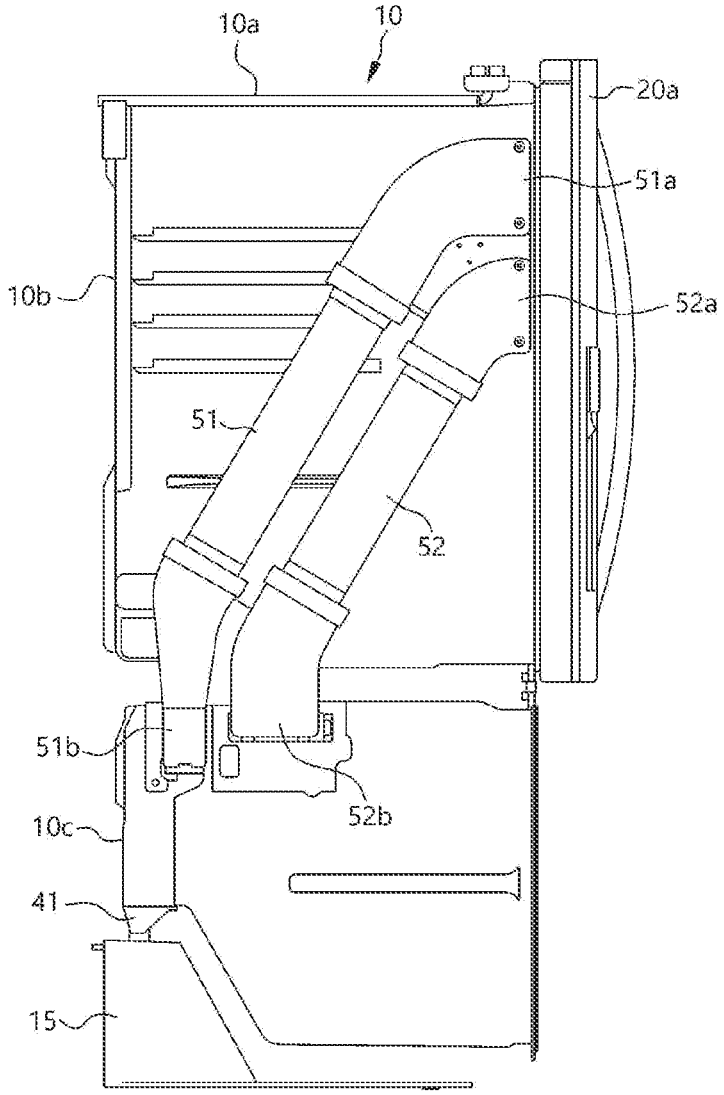
FIG. 12 is a side view showing the refrigerator according to the embodiment of the present disclosure in a state in which the outer casing is removed for showing the installation structure of the cool air duct for the ice-making compartment, the recovery duct for the ice-making compartment, the connection passage, and the recovery duct for the refrigerating compartment.
Figure 13:
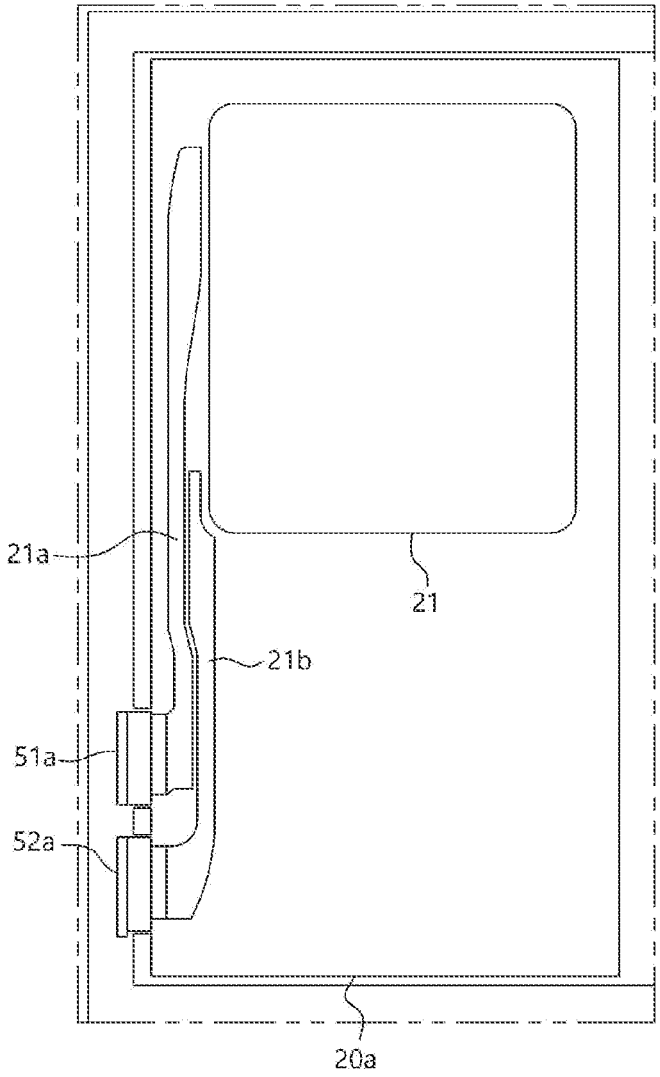
FIG. 13 is a state view schematically showing a passage structure for supply and recovery cool air to/from the ice-making compartment of the refrigerator according to the embodiment of the present disclosure.
Figure 14:
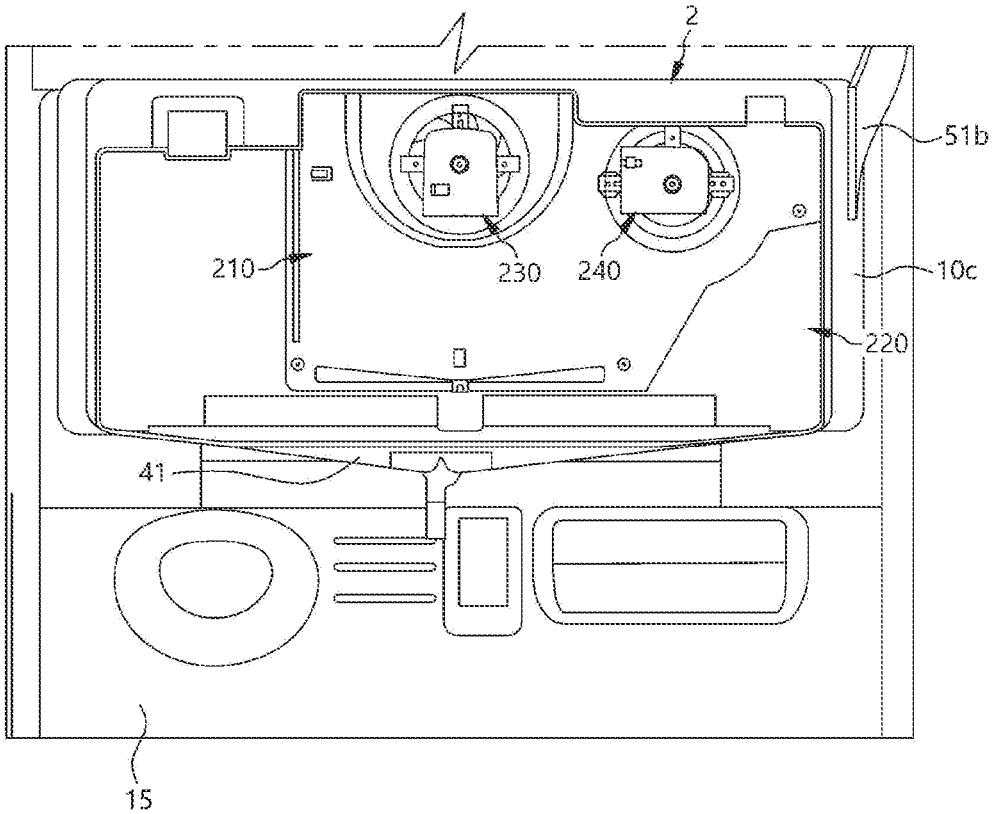
FIG. 14 a main-part view showing a state in which a freezing compartment side grille fan assembly of the refrigerator according to the embodiment of the present disclosure is installed in the freezing compartment.
Figure 15:
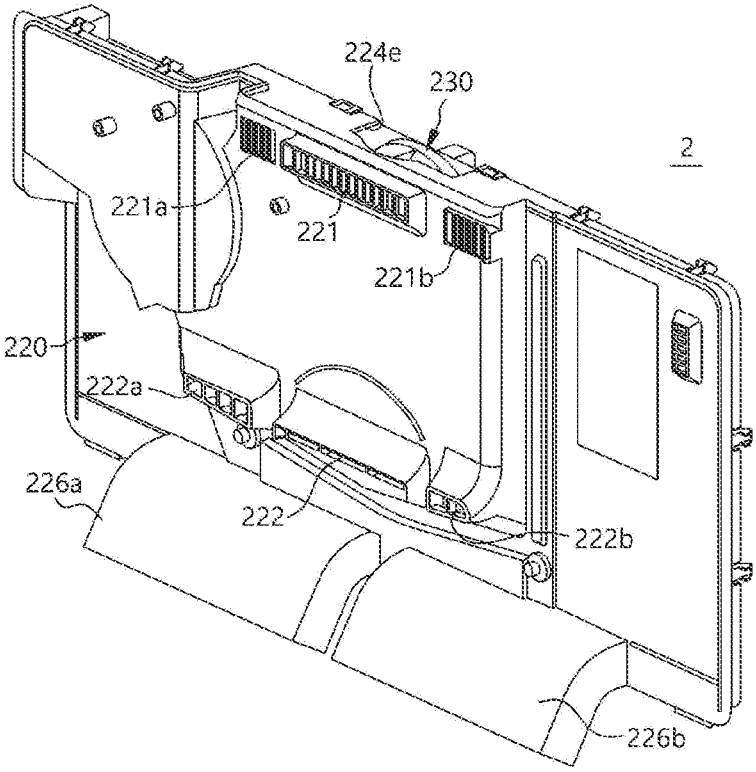
FIG. 15 is a perspective view viewed from the front side, the view showing the freezing compartment side grille fan assembly of the refrigerator according to the embodiment of the present disclosure.

A first end 51*a* of the cool air duct 51 for the ice-making compartment is installed by penetrating any one side surface (a side where the first refrigerating compartment door with the ice-making compartment is located, the right side in the drawing when viewed from the rear surface) of the freezing compartment side grille fan assembly 2. That is, any one side portion between a grille panel 220 and a shroud 210 constituting the freezing compartment side grille fan assembly 2 is formed to be open and constitutes an opening through which cool air of the cool air passage 223 for the ice-making compartment flows out, so that the cool air blown by an ice-making fan 241 may flow smoothly without sudden change of direction. The above structure is as shown in FIGS. 10 and 12.

In addition, a second end 51*b* of the cool air duct 51 for the ice-making compartment is configured to penetrate a side wall of the inner casing 10*b* for the refrigerating compartment to be exposed into the refrigerating compartment 11.

The second end 51*b* of the cool air duct 51 for the ice-making compartment is configured to supply the cool air to a supply guide duct 21*a* while matching with the supply guide duct 21*a* provided in the first refrigerating compartment door 20*a* when the first refrigerating compartment door 20*a* having the ice-making compartment 21 is operated to be closed. The supply guide duct 21*a* is formed to be extended to the ice-making compartment 21 and configured to supply the cool air to the ice-making compartment 21.

In addition, a recovery guide duct 21*b* is provided in the first refrigerating compartment door 20*a*. A first end of the recovery guide duct 21*b* is connected to the ice-making compartment 21 and a second end thereof is formed to be extended to a lower portion of a side wall of the first refrigerating compartment door 20*a*, thereby guiding a recovery flow of the cool air passing through the ice-making compartment 21. The above structure is as shown in FIG. 12.

Further, a recovery duct 52 for the ice-making compartment is provided in a gap between the outer casing 10*a* and any one side wall of the inner casing 10*b*, 10*c* of the cabinet 10.

The recovery duct 52 for the ice-making compartment is a duct for guiding the cool air passing through the ice-making compartment 21 to be recovered to the freezing compartment 12.

A first end 52*a* of the recovery duct 52 for the ice-making compartment is configured to penetrate the side wall of the inner casing 10*b* for the refrigerating compartment to be exposed into the refrigerating compartment 11. The first end 52*a* of the recovery duct 52 for the ice-making compartment is configured to match with the second end of the recovery guide duct 21*b* when the first refrigerating compartment door 20*a* having the ice-making compartment 21 is operated to be closed.

In addition, a second end 52*b* of the recovery duct 52 for the ice-making compartment is configured to pass through a discharge hole 12*a* for recovery (referring to FIGS. 6 and 9) provided in a side wall of the inner casing 10*c* for the freezing compartment to be exposed into the freezing compartment 12.

Meanwhile, according to the embodiment of the present disclosure, the refrigerating compartment side grille fan assembly 1 of the refrigerator is configured to supply cool air, which is provided from the freezing compartment side grille fan assembly 2 through the connection passage 54, to each portion in the refrigerating compartment 11. The freezing compartment side grille fan assembly 2 is configured to selectively supply cool air, which is heat-exchanged by passing through the evaporator 40, to the refrigerating compartment 11, the freezing compartment 12, or the ice-making compartment 21.

The connection passage 54 is configured to connect the center of a lower portion of the refrigerating compartment side grille fan assembly 1 to the center of an upper portion of the freezing compartment side grille fan assembly 2.

The refrigerating compartment side grille fan assembly 1 is configured to supply the cool air, which is supplied from the connection passage 54, to each portion in the refrigerating compartment 11 through a cool air passage 121 for the refrigerating compartment. The refrigerating compartment side grille fan assembly 1 may have a cool air outlet 111, so that the cool air flowing along the cool air passage 121 for the refrigerating compartment is discharged into the refrigerating compartment 11.

In addition, a passage opening and closing module 60 is provided in at least one portion of the refrigerating compartment side grille fan assembly 1 and the connection passage 54. The passage opening and closing module 60 is a configuration that is configured to selectively block the cool air of introduced from the cool air passage 224 for the freezing compartment through the connection passage 54.

That is, by the passage opening and closing module 60, the selective cool air supply may be performed in the cool air passage 121 for the refrigerating compartment of the refrigerating compartment side grille fan assembly 1.

The passage opening and closing module 60 may be provided in a cool air inlet side of the cool air passage 121 for the refrigerating compartment.

That is, the refrigerating compartment side grille fan assembly 1 and the freezing compartment side grille fan assembly 2 are respectively formed in separate bodies and then are configured to communicate with each other through the connection passage 54. In particular, since the cool air passage 121 for the refrigerating compartment of the refrigerating compartment side grille fan assembly 1 does not have any special operating element, it is preferable to install the passage opening and closing module 60 in the refrigerating compartment side grille fan assembly 1 rather than in the connection passage 54 or the freezing compartment side grille fan assembly 2.

A mounting end 101 extended more than the connection duct 60 is provided in the cool air inlet side of the cool air passage 121 for the refrigerating compartment. The passage opening and closing module 60 is configured to be provided in the mounting end 101 and to selectively block the flow of cool air passing through the mounting end 101.

Figure 8:
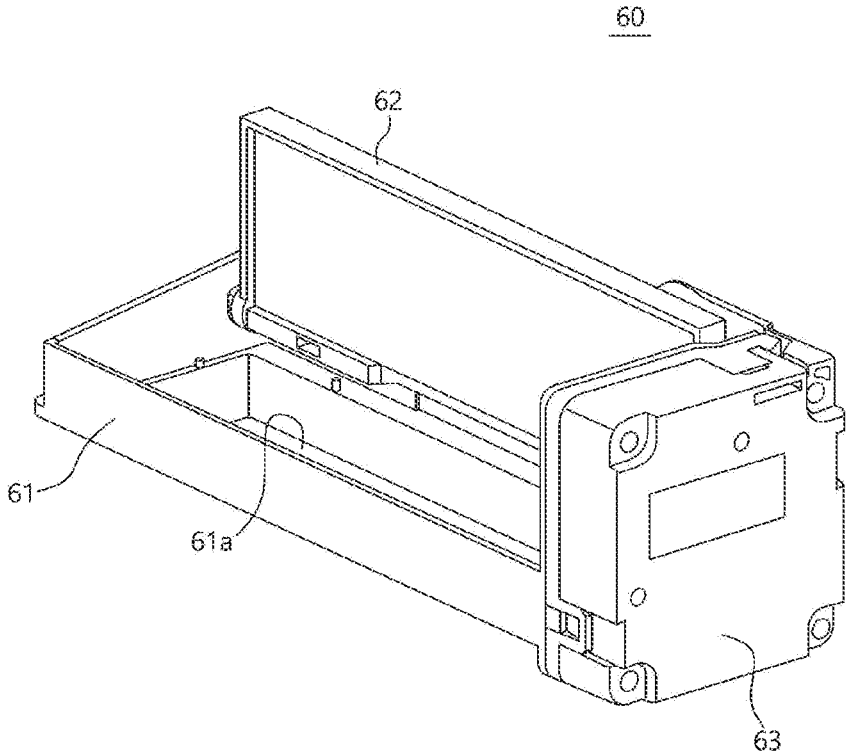
FIG. 8 is a perspective view showing an example of a passage opening and closing module of the refrigerator according to the embodiment of the present disclosure.
Figure 9:
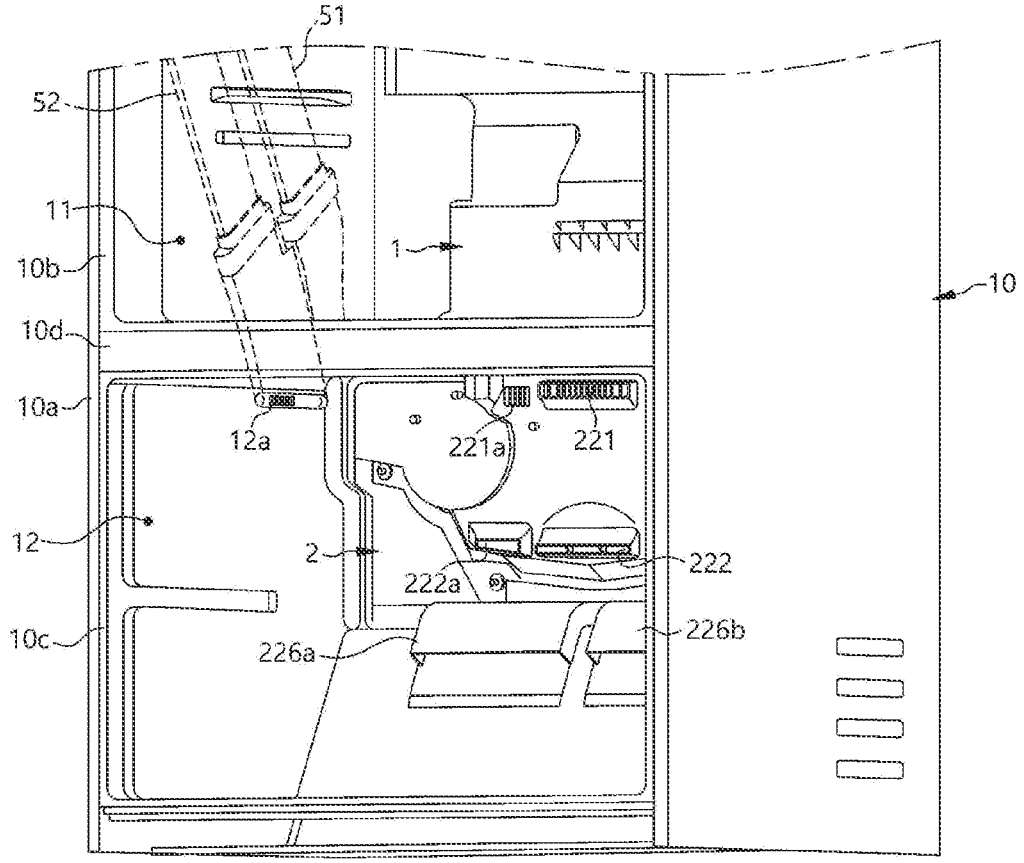
FIG. 9 is a main-part perspective view showing a recovery duct for the ice-making compartment that is connected to a freezing compartment of the refrigerator according to the embodiment of the present disclosure.

As shown in FIG. 8, the passage opening and closing module 60 may include a damper casing 61, an opening and closing damper 62, and a damper operation part 63.

The damper casing 61 is configured to block the inside of the mounting end 101 and is formed in a rectangular frame structure in which a through hole 61*a* is provided. The opening and closing damper 62 is configured to be provided in the damper casing 61 and to open and close the through hole 61*a*.

The damper operation part 63 is configured to operate the opening and closing damper 62.

The damper operation part 63 may be a motor, and the opening and closing damper 62 may be formed in a plate that rotates while being coupled to the motor by a shaft to close or open the through hole 61*a*.

Although not shown in the drawings, the passage opening and closing module 60 may be configured to forcibly close or open a passage through which cool air passes by a solenoid or cylinder, or may be configured in various structures other than that.

According to the embodiment of the present disclosure, the freezing compartment side grille fan assembly 2 has the two cool air passages 223 and 224 that guide the flow of cool air by operations of the two fan modules 230 and 240.

That is, the freezing compartment side grille fan assembly 2 has the cool air passage 224 for the freezing compartment that guides the flow of cool air blown by a freezing fan 231 of a freezing fan module 230, and the freezing compartment side grille fan assembly 2 has the cool air passage 223 for the ice-making compartment that guides the flow of cool air blown by the ice-making fan 241 of an ice-making fan module 240.

In particular, the cool air passage 223 for the ice-making compartment is configured to supply cool air toward a plurality of freezing compartment side cool air outlets 221, 221*a*, 221*b*, 222, 222*a*, and 222*b* located in the cool air passage 224 for the freezing compartment through the supply passage 215*a*, 215*b*.

As described above, according to the embodiment of the present disclosure, by sharing cool air between the two cool air passages 223 and 224 by the supply passage 215*a*, 215*b*, the freezing compartment side grille fan assembly 2 of the refrigerator may supply more cool air to the freezing compartment 12. In addition, when only the ice-making fan 241 is operated, the cool air in the freezing compartment 12 may be prevented from flowing backward.

Hereinbelow, the embodiment with respect to a detailed structure of the freezing compartment side grille fan assembly 2 will be described in detail with reference to FIGS. 14 to 23.

First, the freezing compartment side grille fan assembly 2 includes the shroud 210 and the grille panel 220.

The shroud 210 is a portion providing a rear wall surface of the freezing compartment side grille fan assembly 2, and the grille panel 220 is a portion providing a front wall surface of the freezing compartment side grille fan assembly 2.

The evaporator 40 is located at the rear of the freezing compartment 12 in a rear surface wall of the cabinet 10 (a rear wall surface in the inner casing). The shroud 210 is located at the front of the evaporator 40 and the grille panel 220 is located at the front of the shroud 210.

FIGS. 15 to 19 are perspective views, exploded-perspective views, and front views from various angles, the views showing the freezing compartment side grille fan assembly of the refrigerator according to the embodiment of the present disclosure.

Figure 20:
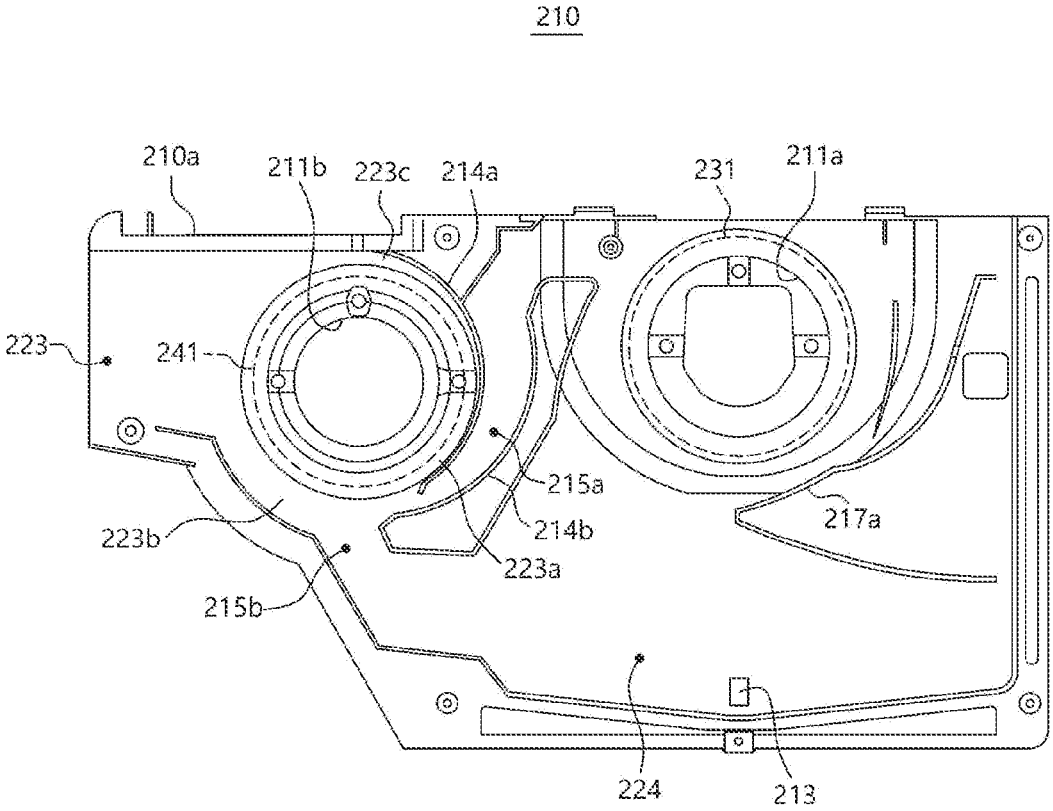
FIG. 20 is a front vie showing a shroud of the freezing compartment side grille fan assembly of the refrigerator according to the embodiment of the present disclosure.
Figure 21:
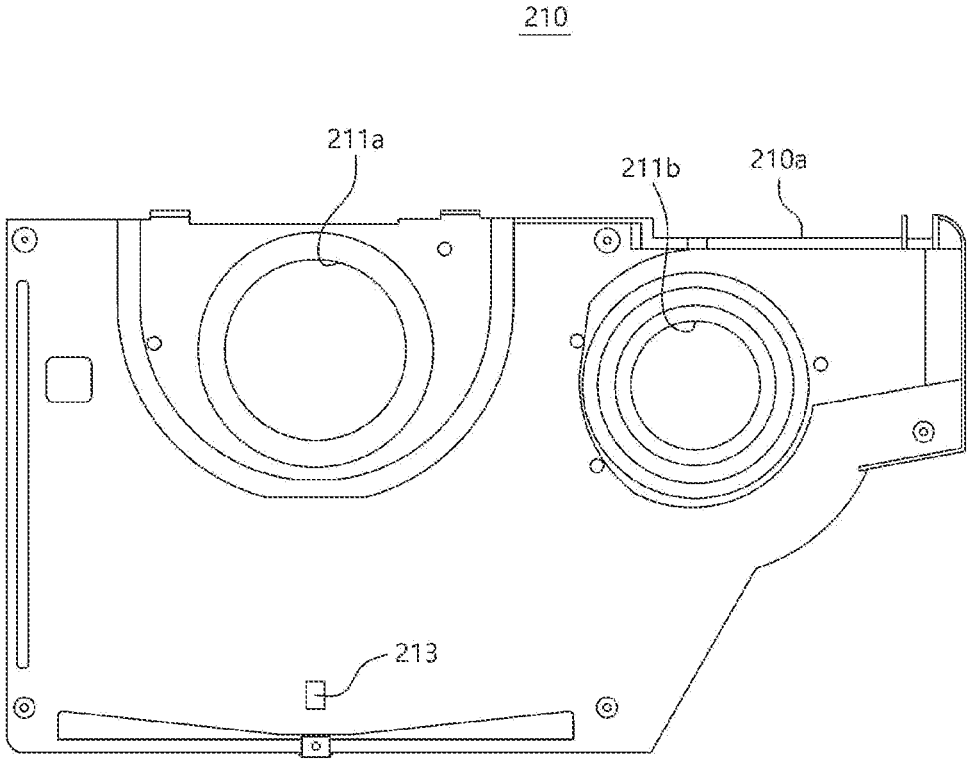
FIG. 21 is a rear view showing the shroud of the freezing compartment side grille fan assembly of the refrigerator according to the embodiment of the present disclosure.
Figure 22:
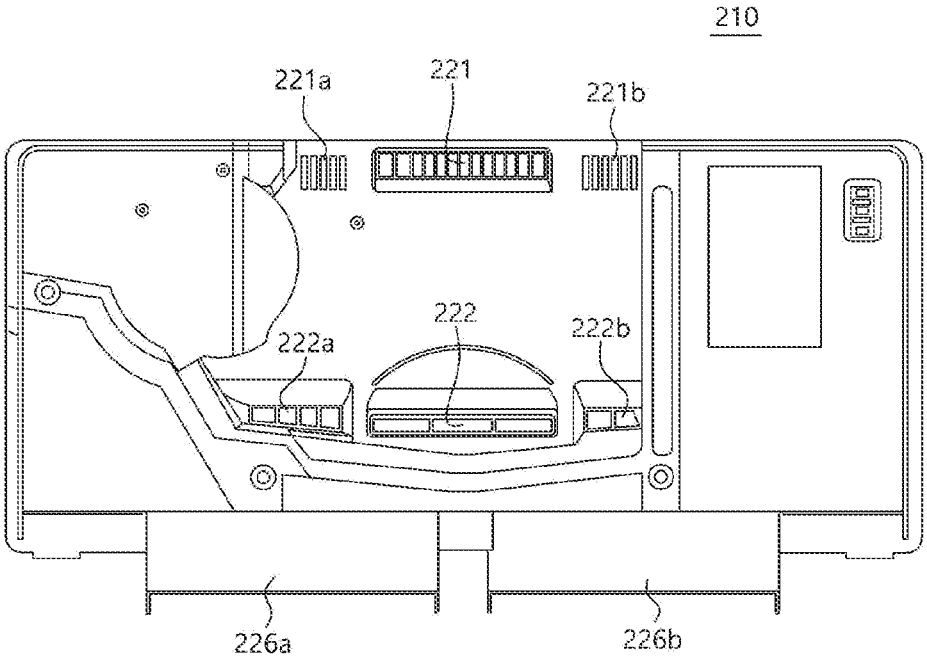
FIG. 22 is a front view showing a grille fan of the freezing compartment side grille fan assembly of the refrigerator according to the embodiment of the present disclosure.
Figure 23:
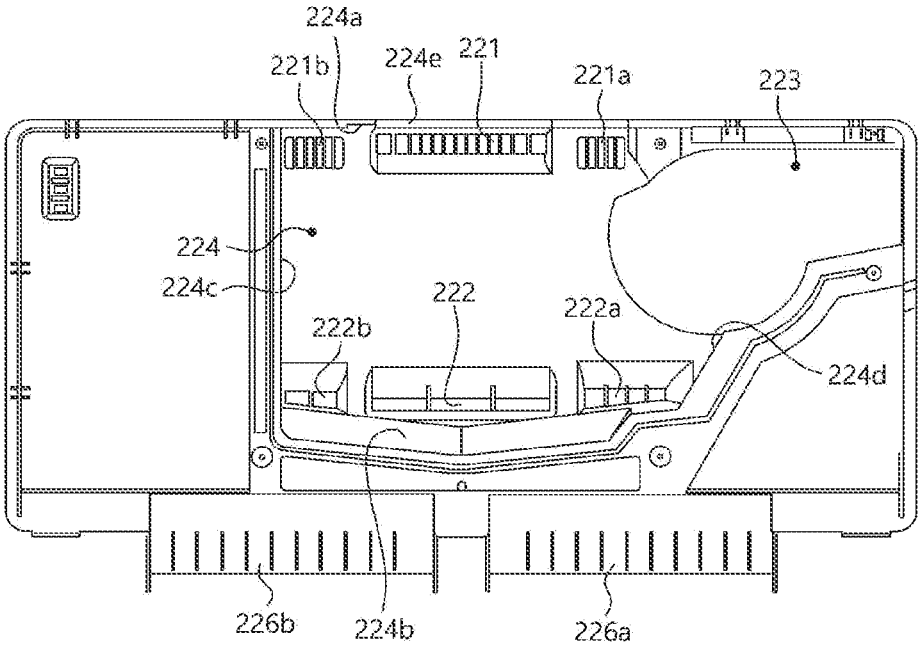
FIG. 23 is a rear view showing the grille fan of the freezing compartment side grille fan assembly of the refrigerator according to the embodiment of the present disclosure.
Figure 24:
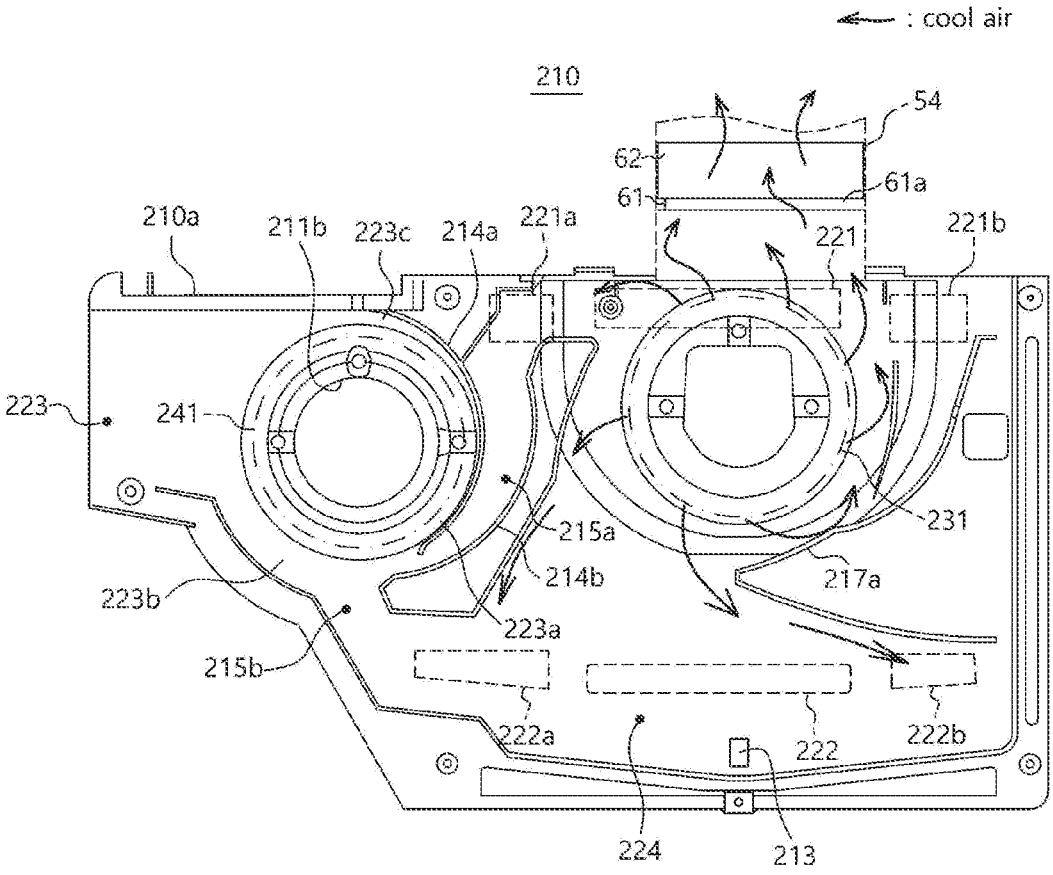
FIG. 24 is a state view showing a front side of the shroud for showing a flow of cool air when the temperature in the refrigerating compartment of the refrigerator according to the embodiment of the present disclosure is controlled.
Figure 25:
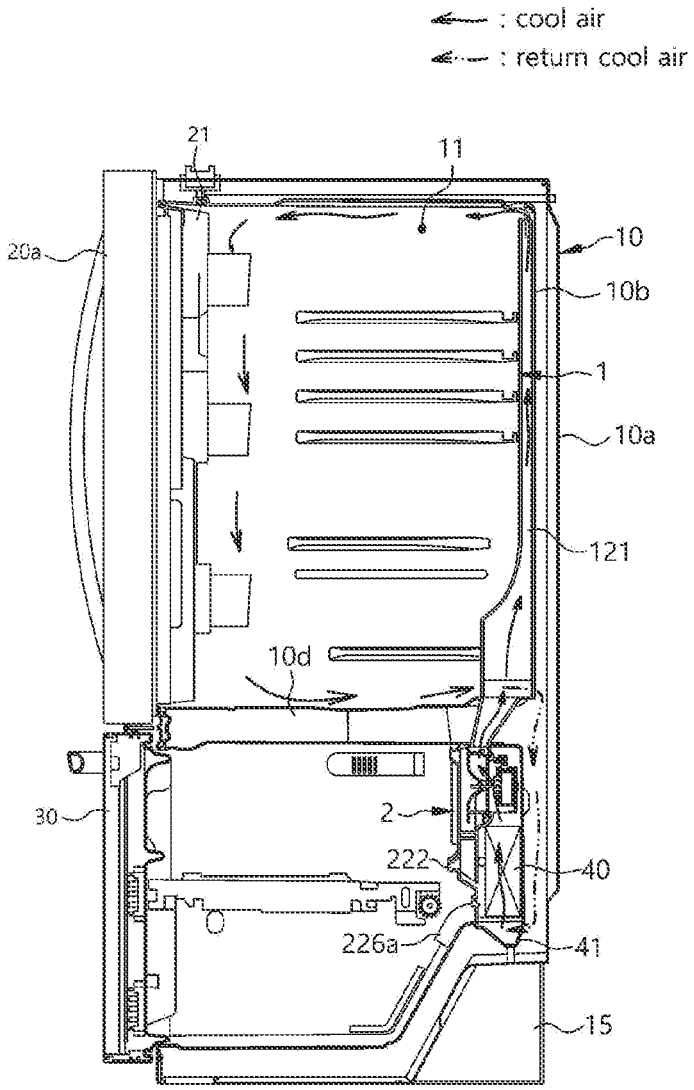
FIG. 25 is a side section view of the refrigerator, the view showing the flow of cool air when the temperature in the refrigerating compartment of the refrigerator according to the embodiment of the present disclosure is controlled.

FIG. 20 is a front vie showing the shroud of the freezing compartment side grille fan assembly of the refrigerator according to the embodiment of the present disclosure. FIG. 21 is a rear view showing the shroud of the freezing compartment side grille fan assembly of the refrigerator according to the embodiment of the present disclosure. FIG. 22 is a front view showing the grille fan of the freezing compartment side grille fan assembly of the refrigerator according to the embodiment of the present disclosure. FIG. 23 is a rear view showing the grille fan of the freezing compartment side grille fan assembly of the refrigerator according to the embodiment of the present disclosure. FIG. 24 is a state view showing a front side of the shroud for showing a flow of cool air when the temperature in the refrigerating compartment of the refrigerator according to the embodiment of the present disclosure is controlled. FIG. 25 is a side section view of the refrigerator, the view showing the flow of cool air when the temperature in the refrigerating compartment of the refrigerator according to the embodiment of the present disclosure is controlled.

As shown in the drawings, the shroud 210 has a first inlet hole 211*a* and a second inlet hole 211*b* that are formed by penetrating the shroud 210.

The two inlet holes 211*a* and 211*b* are provided to allow cool air, which is heat-exchanged while passing through the evaporator 40 located at the rear in the freezing compartment 12, to flow into a gap between the grille panel 220 for the freezing compartment and the shroud 210.

In a front surface of the shroud 210, the freezing fan module 230 is installed in a portion where the first inlet hole 211*a* is formed, and the ice-making fan module 240 is installed in a portion where the second inlet hole 211*b* is formed.

The freezing fan module 230 is located at the first inlet hole 211*a*, and the ice-making fan module 240 is located at the second inlet hole 211*b*.

In particular, the first inlet hole 211*a* is located at an upper center portion of the freezing compartment side grille fan assembly 2. The second inlet hole 211*b* is located at either side of the first inlet hole 211*a*. That is, the freezing fan 231 is located at the center portion of the freezing compartment side grille fan assembly 2, and the ice-making fan 241 is located at either side of the freezing fan 231. Therefore, cool air blown while rotating along a circumference of the freezing fan 231 by the operation of the freezing fan 231 may be evenly supplied to the entire portion in the freezing compartment 12. Cool air blown while rotating along a circumference of the ice-making fan 241 may be conveyed with having a directionality toward the side of the freezing compartment side grille fan assembly 2.

Further, the cool air passage 223 for the ice-making compartment and the cool air passage 224 for the freezing compartment are formed between the front surface of the shroud 210 and a rear surface of the grille panel 220.

The cool air passage 223 for the ice-making compartment is a passage that guides the cool air passing through the second inlet hole 211*b* and flowing into a gap between the shroud 210 and the grille panel 220 to flow into a connection portion with the cool air duct 51 for the ice-making compartment. The cool air passage 224 for the freezing compartment is a passage that guides the cool air blown by the freezing fan 231 to each portion in the freezing compartment 12.

The cool air passage 224 for the freezing compartment is formed to surround the circumference of the freezing fan 231 and is configured to guide the flow of the cool air blown while rotating along the circumference of the freezing fan 231. The cool air passage 223 for the ice-making compartment is formed to surround the circumference of the ice-making fan 241 and is configured to guide the flow of the cool air blown while rotating along the circumference of the ice-making fan 241. The cool air passage 223 for the ice-making compartment is formed to be open by penetrating a side of opposite sides of the wall surface of the freezing compartment side grille fan assembly 2, the side being located adjacent to the ice-making fan 241.

In particular, the cool air passage 223 for the ice-making compartment and the cool air passage 224 for the freezing compartment are formed by recessing the rear surface of the grille panel 220. The shroud 210 is configured such that the front surface thereof is in close contact with the rear surface of the grille panel 220 to cover the recessed portions of the grille panel 220 (portions where the cool air passage for the freezing compartment and the cool air passage for the ice-making compartment are provided).

Although not shown in the drawings, the cool air passage 224 for the freezing compartment and the cool air passage 223 for the ice-making compartment may be formed by recessing the front surface of the shroud 210, and may be formed by partially recessing the facing surfaces between the shroud 210 and the grille panel 220.

That is, according to the embodiment of the present disclosure, the cool air passage 224 for the freezing compartment and the cool air passage 223 for the ice-making compartment may be formed on at least one of the facing surface between the grille panel 220 and the shroud 210.

Figure 18:
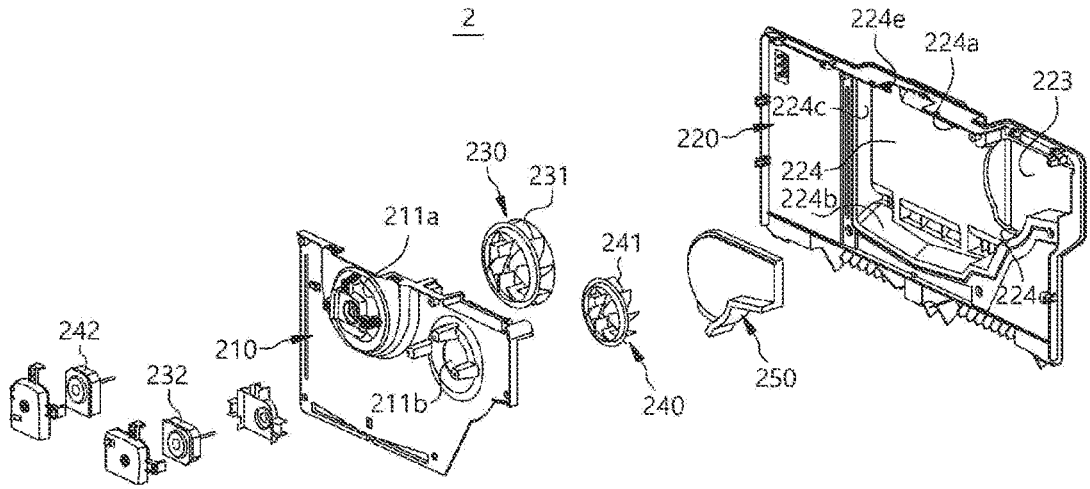
FIG. 18 is an exploded-perspective view viewed from the rear side, the view showing the freezing compartment side grille fan assembly of the refrigerator according to the embodiment of the present disclosure.

Further, the cool air passages 223 and 224 are formed by recessing the wall surface of the grille panel 220, the grille panel 220 has an upper wall surface 224*a*, a lower wall surface 224*b*, a first side wall surface 224*c*, and a second side wall surface 224*d* (referring to FIGS. 18 and 23).

The upper wall surface 224*a* is an upper wall surface in the cool air passage 224 for the freezing compartment, the surface being located at the upper side of the freezing fan 231. The lower wall surface 224*b* is a bottom surface in the cool air passage 224 for the freezing compartment, the surface being located at the lower side of the freezing fan 231. The first side wall surface 224*c* is a first side wall surface in the cool air passage 224 for the freezing compartment, the surface being located at either side of the freezing fan 231. The second side wall surface 224*d* is a second side wall surface in the cool air passage 224 for the freezing compartment, the surface being located at another side of the freezing fan 231 and at the lower side of the ice-making fan 241.

In particular, a cool air outlet 224*e* is formed in the upper wall surface 224*a* of the grille panel 220, and the cool air outlet 224*e* is connected to a lower end of the connection passage 54.

That is, due to the cool air outlet 224*e* and the connection passage 54, the cool air passage 224 for the freezing compartment may communicate with the cool air passage 121 for the refrigerating compartment. Further, cool air flowing toward an upper space of the cool air passage 224 for the freezing compartment may be supplied to the cool air passage 121 for the refrigerating compartment.

In addition, the lower wall surface 224*b* of the cool air passage 224 for the freezing compartment is formed to be inclined downward to the center thereof. A drainage hole 213 is formed in a portion of each portion of the shroud 210, the portion of the shroud 210 facing a center portion of a lower wall surface of the cool air passage 224 for the freezing compartment. That is, condensed water flowing along the side wall surfaces 224*c* and 224*d*, condensed water flowing along opposite sides of the lower wall surface 224*b*, and condensed water occurring in the cool air passage 224 for the freezing compartment come together in the center portion of the lower wall surface 224*b*, and then the collected condensed water is discharged out of the freezing compartment side grille fan assembly 2 through the drainage hole 213. The discharged condensed water falls to a water spout 41 provided in a lower portion of the evaporator 40.

Further, the grille panel 220 has the plurality of freezing compartment side cool air outlets 221, 221*a*, 221*b*, 222, 222*a*, and 222*b* that discharge cool air in the cool air passage 224 for the freezing compartment to the freezing compartment 12.

The freezing compartment side cool air outlets 221, 221*a*, 221*b*, 222, 222*a*, and 222*b* include a cool air outlet 221 for an upper space, the outlet 221 being located at the upper side of the freezing fan 231, and a cool air outlet 222 for a middle space, the outlet 222 being located at the lower side of the freezing fan 231. That is, cool air flowing into the upper side of the freezing fan 231 is discharged into the upper space in the freezing compartment 12 through the cool air outlet 221 for an upper space, and cool air flowing into the lower side of the freezing fan 231 is discharged to the middle space in the freezing compartment 12 through the cool air outlet 222 for the middle space.

First auxiliary cool air outlets 221*a* and 221*b* are provided at opposite sides of the cool air outlet 221 for the upper space, and second auxiliary cool air outlets 222*a* and 222*b* are provided at opposite sides of the cool air outlet 222 for a middle space. Thus, cool air may be sufficiently supplied to opposite sides of the upper space and opposite sides of the middle space in the freezing compartment 12.

Figure 16:
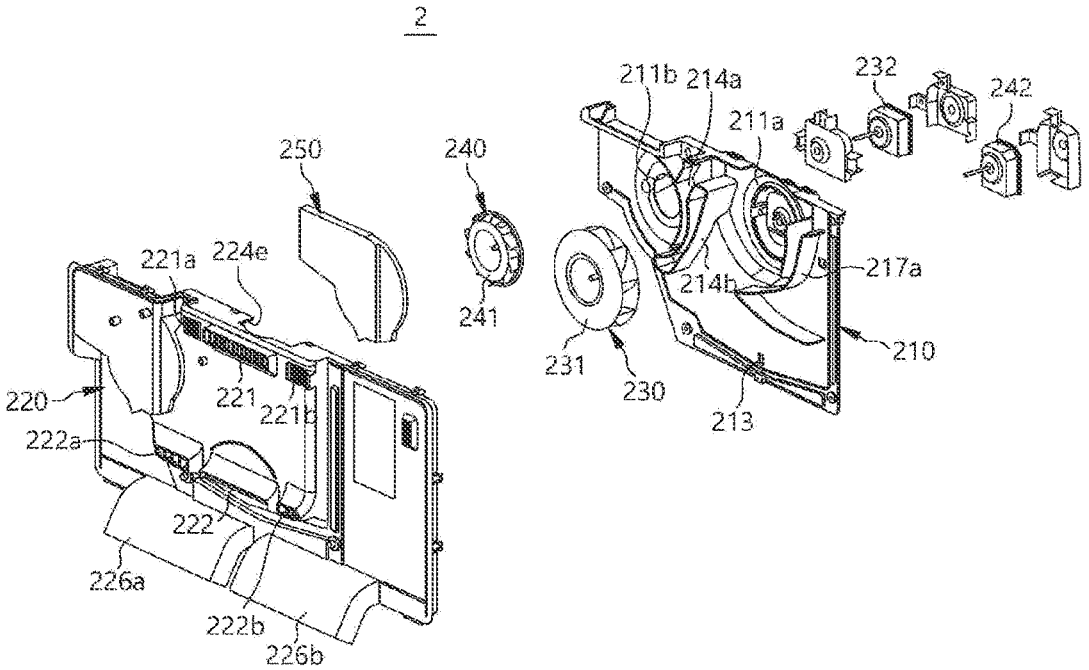
FIG. 16 is an exploded-perspective view viewed from the front side, the view showing the freezing compartment side grille fan assembly of the refrigerator according to the embodiment of the present disclosure.
Figure 17:
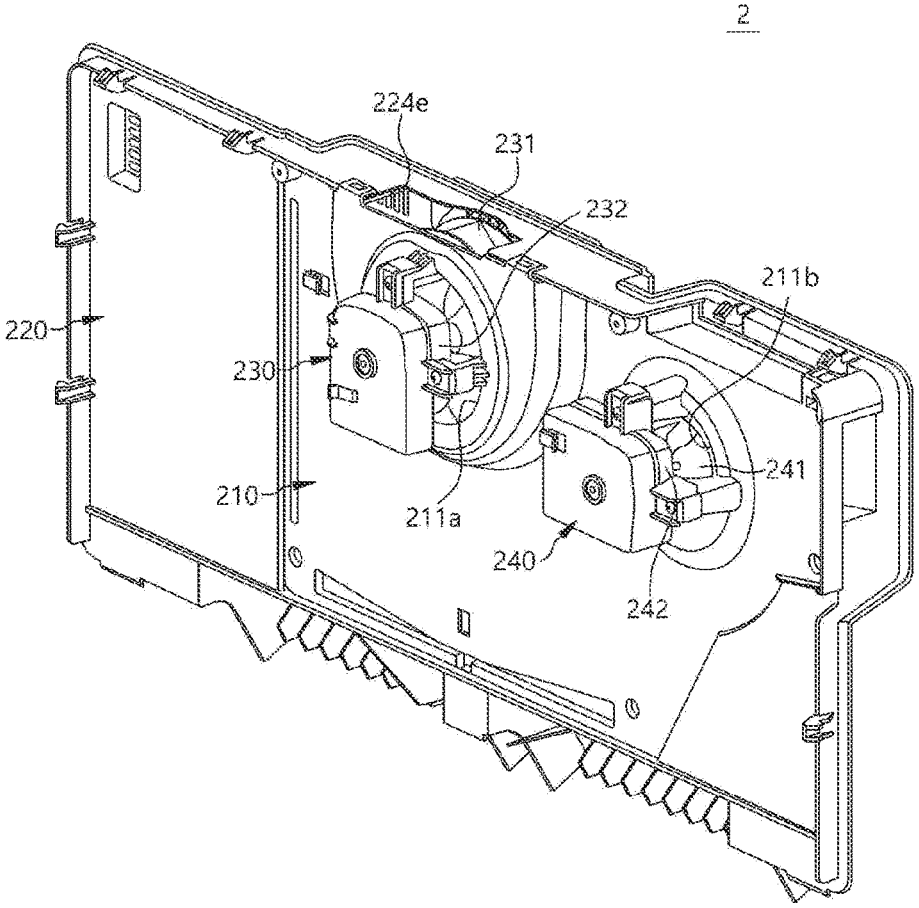
FIG. 17 is a perspective view viewed from the rear side, the view showing the freezing compartment side grille fan assembly of the refrigerator according to the embodiment of the present disclosure.

Further, the cool air passage 224 for the freezing compartment and the cool air passage 223 for the ice-making compartment are partitioned from each other by passage ribs 214*a* and 214*b* (shown in FIG. 16). That is, as the passage ribs 214*a* and 214*b* are formed by protruding from the front surface of the shroud 210, the cool air passage 224 for the freezing compartment and the cool air passage 223 for the ice-making compartment may have respective passages portioned from each other. Although not shown in the drawings, the passage ribs 214*a* and 214*b* may be formed by protruding from the rear surface of the grille panel 220.

The passage ribs 214*a* and 214*b* protrude from the front surface of the shroud 210 and form a circumferential wall surface of the cool air passage 223 for the ice-making compartment. That is, the cool air introduced through the second inlet hole 211*b* is guided to the connection portion with the cool air duct 51 for the ice-making compartment by flowing along the cool air passage 223 for the ice-making compartment formed by the passage rib 223*a*, 223*b*.

The passage ribs 214*a* and 214*b* include a first circumferential passage rib 214*a* and a second circumferential passage rib 214*b* that are formed along a circumference of the second inlet hole 211*b*.

The portion where the second inlet hole 211*b* is provided may be partitioned from the cool air passage 224 for the freezing compartment by the two circumferential passage ribs 214*a* and 214*b*. The cool air passing through the second inlet hole 211*b* may be blown along the cool air passage 223 for the ice-making compartment formed by the passage ribs 214*a* and 214*b* into the cool air duct 51 for the ice-making compartment.

The first circumferential passage rib 214*a* is extended downward from an upper surface 210*a* of the shroud 210, and formed to cross between the freezing fan 231 and the ice-making fan 241. The upper surface 210*a* of the shroud 210 forms an upper surface of the freezing compartment side grille fan assembly 2 together with the upper wall surface 224*a*. A part of the upper surface 210*a* of the shroud 210 is configured to form an upper surface of the cool air passage 223 for the ice-making compartment and to guide the flow of cool air.

In addition, a lower end of the first circumferential passage rib 214*a* is formed to be located lower than a center height of the freezing fan 231. That is, as the first circumferential passage rib 214*a* is configured to cross between the ice-making fan module 240 and the freezing fan module 230, cool air blown along the circumference of the freezing fan 231 by the operation of the freezing fan 231 is prevented from interference caused by directly colliding with cool air blown along the circumference of the ice-making fan 241 by the operation of the ice-making fan 241.

In particular, the first circumferential passage rib 214*a* is formed in a round shape to surround a part of the circumference of the ice-making fan 241, the part of the circumference corresponding to the side where the freezing fan is located. Thus, cool air blown in a radial direction of the ice-making fan 241 by the operation of the ice-making fan 241 flows in a circumferential direction of the ice-making fan 241 by guidance of the first circumferential passage rib 214*a* and may be smoothly provided into a communication portion with the cool air duct 51 for the ice-making compartment (an open portion of the cool air passage for the ice-making compartment).

The second circumferential passage rib 214*b* is located in a portion between the first circumferential passage rib 214*a* and the freezing fan 231 in the front surface of the shroud 210, and is formed in a round shape to surround a lower circumference of the first circumferential passage rib 214*a*. That is, the second circumferential passage rib 214*b* partitions a lower portion between the ice-making fan 241 and the freezing fan 231 from a center portion.

In addition, the second circumferential passage rib 214*b* is formed to be spaced apart from the first circumferential passage rib 214*a*. The space between the first circumferential passage rib 214*a* and the second circumferential passage rib 214*b* is provided an upper supply passage 215*a*.

That is, part of cool air flowing along the cool air passage 223 for the ice-making compartment may be supplied into the upper space in the cool air passage 224 for the freezing compartment through the upper supply passage 215*a*.

Accordingly, when the freezing fan 231 and the ice-making fan 241 are operated at the same time, as part of the cool air blown by the ice-making fan 241 is additionally supplied to the freezing compartment 12 through the upper supply passage 215*a*, the amount of cool air supplied to the freezing compartment 12 may be increased and thus the temperature control in the freezing compartment 12 may be performed quickly.

In addition, when the freezing fan 231 is not operated and only the ice-making fan 241 is operated, the pressure of the second inlet hole 211*b* with the ice-making fan 241 is relatively lower than the pressure of the first inlet hole 211*a*. After cool air in the freezing compartment 12 passes through the cool air passage 224 for the freezing compartment and passes to a portion where the evaporator 40 is located through the first inlet hole 211*a*, the cool air may be suctioned into the cool air passage 223 for the ice-making compartment through the second inlet hole 211*b*.

However, due to the provision of the above-described upper supply passage 215*a*, even when only the ice-making fan 241 is operated, pressure difference between the two passages 223 and 224 is reduced by sharing of cool air between the cool air passage 224 for the freezing compartment and the cool air passage 223 for the ice-making compartment. Accordingly, the cool air in the freezing compartment 12 is prevented from flowing back into the cool air passage 223 for the ice-making compartment.

Further, an upper end of the second circumferential passage rib 214*b* is formed to be located higher than the center height of the freezing fan 231. Accordingly, cool air blown in a radial direction of the freezing fan 231 by the operation of the freezing fan 231 is prevented from interfering with cool air discharge of the upper supply passage 215*a* while flowing back into the upper supply passage 215*a* through a cool air outlet of the upper supply passage 215*a*.

In addition, the open upper portion (the open upper portion between the first circumferential passage rib and the second circumferential passage rib) of the upper supply passage 215*a* is formed to face an auxiliary cool air outlet 221*a* of the ice-making fan 241. That is, cool air supplied to the cool air passage 224 for the freezing compartment through the upper supply passage 215*a* may be directly discharged to the upper space in the freezing compartment 12 through the auxiliary cool air outlet 221*a* without interfering with the flow of cool air flowing in the cool air passage 224 for the freezing compartment.

Further, a wall surface of the upper end of the second circumferential passage rib 214*b* and which faces the freezing fan 231 is formed to be inclined or rounded to be adjacent to the freezing fan 231 as the second circumferential passage rib 214*b* goes to the upper end thereof. That is, the cool air blown while rotating along an upper circumference of the freezing fan 231 by the operation of the freezing fan 231 may be sufficiently supplied to the cool air outlet 221 for an upper space and the first auxiliary cool air outlets 221*a* and 221*b* that are located at the opposite sides of the cool air outlet 221 by guidance of the second circumferential passage rib 214*b*.

Meanwhile, a lower end of the second circumferential passage rib 214*b* is formed to surround beyond the lower circumference of the first circumferential passage rib 214*a* to a part of a lower circumference of the ice-making fan 241.

In addition, the lower end of the second circumferential passage rib 214*b* is formed to be spaced apart from the second side wall surface 224*d* of the grille panel 220. Thus, a lower supply passage 215*b* is provided between the second circumferential passage rib 214*b* and the second side wall surface 224*d*.

That is, cool air blown to a lower space in the cool air passage 223 for the ice-making compartment of the cool air blown while rotating in the circumferential direction of the ice-making fan 241 by the operation of the ice-making fan 241 is additionally supplied to a lower space in the cool air passage 224 for the freezing compartment through the lower supply passage 215*b*. Whereby, the amount of the cool air supplied to the freezing compartment 12 may be increased.

In particular, the condensed water in the cool air passage 223 for the ice-making compartment is discharged through the lower supply passage 215*b*, thereby preventing condensate of the ice-making fan 241 due to the condensed water.

The condensed water discharged to the cool air passage 224 for the freezing compartment through the lower supply passage 215*b* is gathered in the center of the lower wall surface 224*b* in the cool air passage 224 for the freezing compartment. Then, the condensed water is discharged to the outside of the freezing compartment side grille fan assembly 2 through the drainage hole 213 of the shroud 210.

Further, the cool air passage 223 for the ice-making compartment is divided in a plurality of areas on the basis of positions of the ice-making fan 241 and the passage ribs 214*a* and 214*b* of each circumferential sides of the shroud 210.

That is, the cool air passage 223 for the ice-making compartment includes: a first area 223*a* that is provided between the ice-making fan 241 and the first circumferential passage rib 214*a*; a second area 223*b* that is provided between the ice-making fan 241 and the second circumferential passage rib 214*b*; and a third area 223*c* that is provided between the ice-making fan 241 and the upper wall surface 224*a* of the grille panel 220. In the drawings, each area 223*a*, 223*b*, 223*c* of the cool air passage 223 for the ice-making compartment, the cool air passage 223 for the ice-making compartment, and the cool air passage 224 for the freezing compartment are shown on the basis of the second inlet hole 211*b* and the first inlet hole 211*a* formed in the shroud 210, and the above structure is as shown in FIG. 20.

Meanwhile, an insulating member 250 may be provided in a portion of the rear surface of the grille panel 220*m*, the portion where the cool air passage 223 for the ice-making compartment is located.

The insulating member 250 is configured to prevent condensation of the ice-making fan 241 and to cover a wall surface of a grille fan side of the cool air passage 223 for the ice-making compartment.

That is, there is concern that the ice-making fan 241 located to be adjacent to a portion where the condensed water is recovered freezes, considering that the cool air is in a state of high temperature and high humidity compared to the cool air in the freezing compartment 12. Accordingly, freezing of the ice-making fan 241 may be prevented by provision of the insulating member 250.

Further, a guide 217*a* may be formed in the front surface of the shroud 210 (or the rear surface of the grille fan).

The guide 217*a* serves to guide cool air passing through the first inlet hole 211*a* of the shroud 210 and flowing into the cool air passage 224 for the freezing compartment to smoothly flow into two auxiliary cool air outlets 221*b* and 222*b* (based on the freezing fan, the auxiliary cool air outlets 221*b* and 222*b* are located at a side opposite to a side with the ice-making fan).

Further, the grille panel 220 has suction guides 226*a* and 226*b* guiding a recovery flow of the cool air flowing through the freezing compartment 12. The suction guides 226*a* and 226*b* are provided in lower ends of the grille panel 220 and are configured to allow the cool air recovered after circulating in the freezing compartment 12 to flow into a lower end of the evaporator 40.

Each of the suction guides 226*a* and 226*b* is formed to be inclined (or rounded) at an angle the same (or similar) as a wall constituting the rear side bottom of the freezing compartment 12, as the suction guide goes to the lower end thereof. That is, the cool air flowing along a lower surface of the freezing compartment 12 may be guided by the suction guides 226*a* and 226*b* to smoothly flow to the lower end of the evaporator 40.

The freezing compartment side grille fan assembly 2 includes the freezing fan module 230 and the ice-making fan module 240.

The freezing fan module 230 is a configuration that blows cool air passing through the evaporator 40 to the cool air passage 224 for the freezing compartment, and is located in the first inlet hole 211*a* of the shroud 210.

In addition, the freezing fan module 230 includes the freezing fan 231 and a fan motor 232.

The freezing fan 231 may be a centrifugal fan, and the fan motor 232 is configured to be shaft-coupled to the freezing fan 231 while being fixed to the shroud 210.

In particular, the freezing fan 231 may be a type of fan providing a larger air volume than the ice-making fan 241. That is, the freezing fan 231 may be a fan having a size larger than the ice-making fan 241. Therefore, a portion of the shroud 210 where the freezing fan 231 is provided is formed to be recessed compared to other portions, so that the portion with the freezing fan 231 may be located concavely.

Further, ice-making fan module 240 is a configuration that blows the cool air passing through the evaporator 40 to the cool air passage 223 for the ice-making compartment, and is located in the second inlet hole 211*b* of the shroud 210.

In addition, the ice-making fan module 240 includes the ice-making fan 241 and a fan motor 242.

The ice-making fan 241 may be a centrifugal fan, and the fan motor 242 is configured to be shaft-coupled to the ice-making fan 241 while being fixed to the shroud 210.

In particular, the ice-making fan 241 may be a type of fan capable of conveying cool air to a longer distance than the freezing fan 231. That is, the ice-making fan 241 may be a type of fan having a rotational speed higher than the freezing fan 231.

Figure 19:
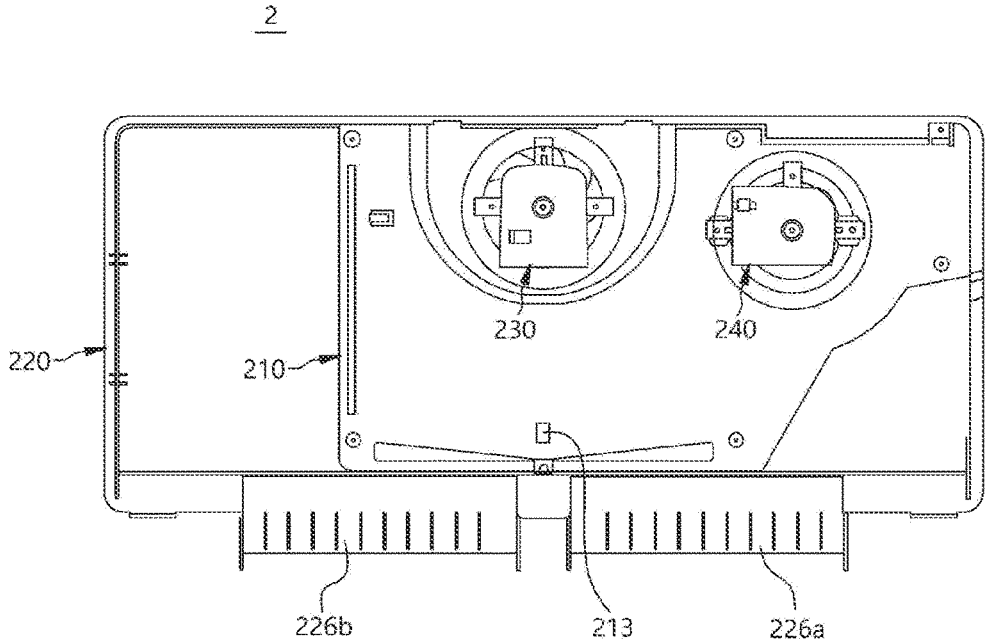
FIG. 19 is a front view showing the freezing compartment side grille fan assembly of the refrigerator according to the embodiment of the present disclosure.

Meanwhile, the ice-making fan module 240 is configured to be located at a predetermined distance from a cool air outlet side of the cool air passage 223 for the ice-making compartment (referring to FIG. 19).

That is, as the ice-making fan 241 of the ice-making fan module 240 is located to be spaced apart from the cool air outlet side (open portion) of the cool air passage 223 for the ice-making compartment at a sufficient distance, the cool air passing through the cool air outlet side of the cool air passage 223 for the ice-making compartment may be prevented from non-passing through the cool air outlet side, and the cool air may be prevented from becoming turbulent due to the resistance caused by the flow of the cool air rotating in the rotation direction of the ice-making fan 241.

In addition, the ice-making fan 241 constituting the ice-making fan module 240 may be configured to rotate at a rotational speed higher than that of the freezing fan 231 constituting the freezing fan module 230.

That is, in the case of the freezing fan 231, since the freezing fan 231 supplies the cool air to the freezing compartment 12 in the front of the freezing fan 231, the freezing fan rotates at a rotation speed sufficient to provide a high air volume. However, in the case of the ice-making compartment 21, since the ice-making compartment 21 is located relatively father than the freezing compartment 12, the ice-making fan 241 is operated at a rotational speed higher than that of the freezing fan 231 so that the cool air is conveyed to the ice-making compartment 21.

In addition, the center of the ice-making fan 241 is located lower than the center of the open portion at the cool air outlet side of the cool air passage 223 for the ice-making compartment.

That is, based on the center portion of the ice-making fan 241, cool air discharged upward is guided to be supplied to the ice-making compartment 21 through the cool air passage 223 for the ice-making compartment. Considering the above structure, the center portion of the ice-making fan 241 is located lower than the center at the cool air outlet side (preferably, the lower surface of the cool air discharge portion) of the cool air passage 223 for the ice-making compartment, it is possible to allow the cool air blown from the ice-making fan 241 to be flow smoothly along the cool air passage 223 for the ice-making compartment.

Hereinbelow, according to the embodiment of the present disclosure, the temperature control process for the freezing compartment 12 and the ice-making compartment 21 of the refrigerator will be described in detail.

Figure 26:
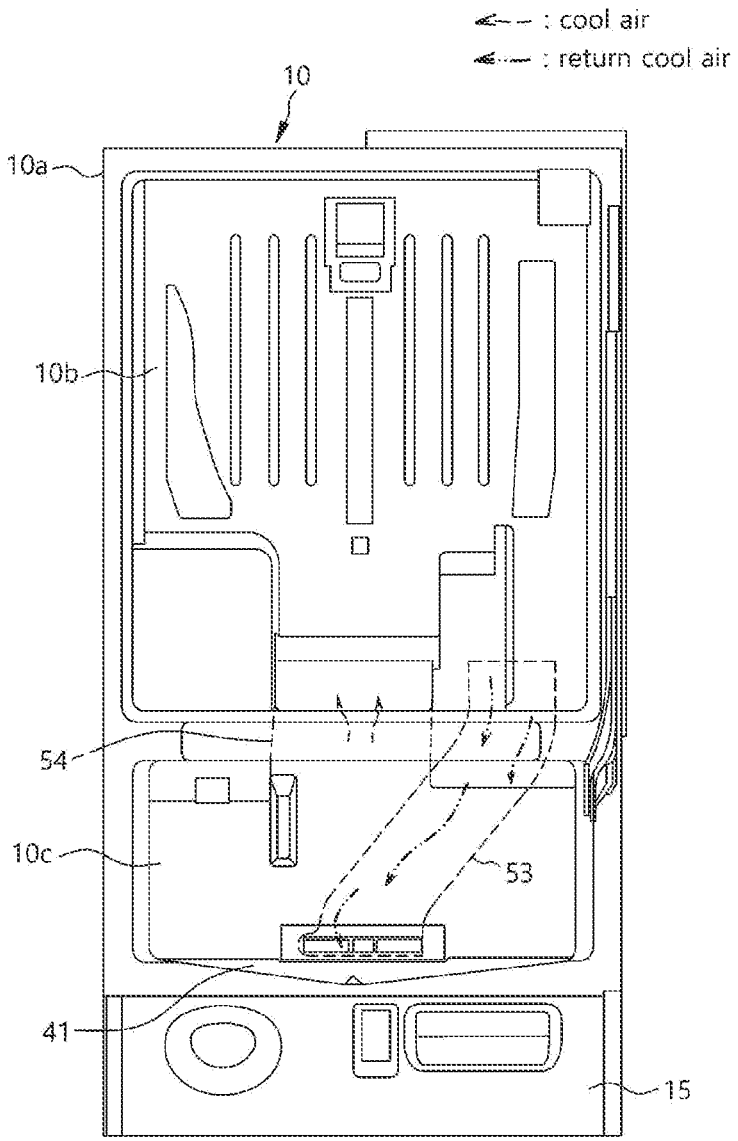
FIG. 26 is a sate view showing flows of cool air of the connection passage and the recovery duct for the refrigerating compartment when the temperature in the refrigerating compartment of the refrigerator according to the embodiment of the present disclosure is controlled.

The temperature control process of the refrigerating compartment 11 may be described with reference to FIGS. 24 to 26.

The temperature control of the refrigerating compartment 11 is performed by the operations of the freezing fan module 230, the compressor (not shown), and the passage opening and closing module 60.

That is, the passage opening and closing module 60 is operated, so that the connection passage 54 and the cool air passage 121 for the refrigerating compartment are opened to each other (referring to FIG. 16). Then, when the freezing fan 231 rotates and the compressor is operated by power supply to the freezing fan module 230, the heat exchange of the evaporator 40 is performed, and thus the operation for controlling the temperature of the refrigerating compartment 11 is performed.

When the freezing fan 231 of the freezing fan module 230 is operated, air in the freezing compartment 12 flows to pass through the evaporator 40 by a blowing force of the freezing fan 231, thereby being heat-exchanged while passing through the evaporator 40.

Further, the heat exchanged air (cool air) passes through the first inlet hole 211*a* of the shroud 210 and then flows into the cool air passage 224 for the freezing compartment.

The cool air flowing into the upper space in the cool air passage 224 for the freezing compartment and blown to the upper space in the cool air passage 224 for the freezing compartment is discharged through the cool air outlet 224*e* by guidance of the first guide 217*a*. Continuously, the connection passage 54 guides the cool air to be supplied into the cool air passage 121 for the refrigerating compartment.

In the cool air blown while rotating along the upper circumference of the freezing fan 231 by the operation of the freezing fan 231, remaining cool air that has not been discharged through the cool air outlet 224*e* is supplied to the freezing compartment 12 through a portion in the cool air passage 224 for the freezing compartment where the cool air outlet 221 for an upper space is located and the two first auxiliary cool air outlets 221*a* and 221*b* located at the opposite sides of the cool air outlet 221 for an upper space.

By the above process, the cool air supplied to the cool air passage 121 for the refrigerating compartment is supplied into the refrigerating compartment 11 through a cool air outlet 111 while flowing along the cool air passage 121 for the refrigerating compartment, thereby refrigerating the object to be stored in the refrigerating compartment 11.

The cool air that has refrigerated the object to be stored in the refrigerating compartment 11 flows into the lower portion in the refrigerating compartment 11 and then is recovered to the cool air inlet side of the evaporator 40 through the recovery duct 53 for the refrigerating compartment connected thereto. The recovered cool air performs repeated circulation of passing through the evaporator 40 and then flowing into the freezing compartment side grille fan assembly, and being supplied into the refrigerating compartment.

Meanwhile, when the inside of the refrigerating compartment 11 reaches a preset temperature by the above-described operation, the passage opening and closing module 60 is operated to block between the connection passage 54 and the cool air passage 121 for the refrigerating compartment. As a result, additional cool air supply to the refrigerating compartment 11 is not performed.

That is, when the passage opening and closing module 60 blocks the connection passage 54 and the cool air passage 121 for the refrigerating compartment, the cool air blown by the freezing fan 231 is completely supplied only to the freezing compartment 12. When the refrigerating compartment 11 reaches a preset temperature, the freezing fan 231 and the compressor may be controlled to stop operations thereof.

Figure 27:
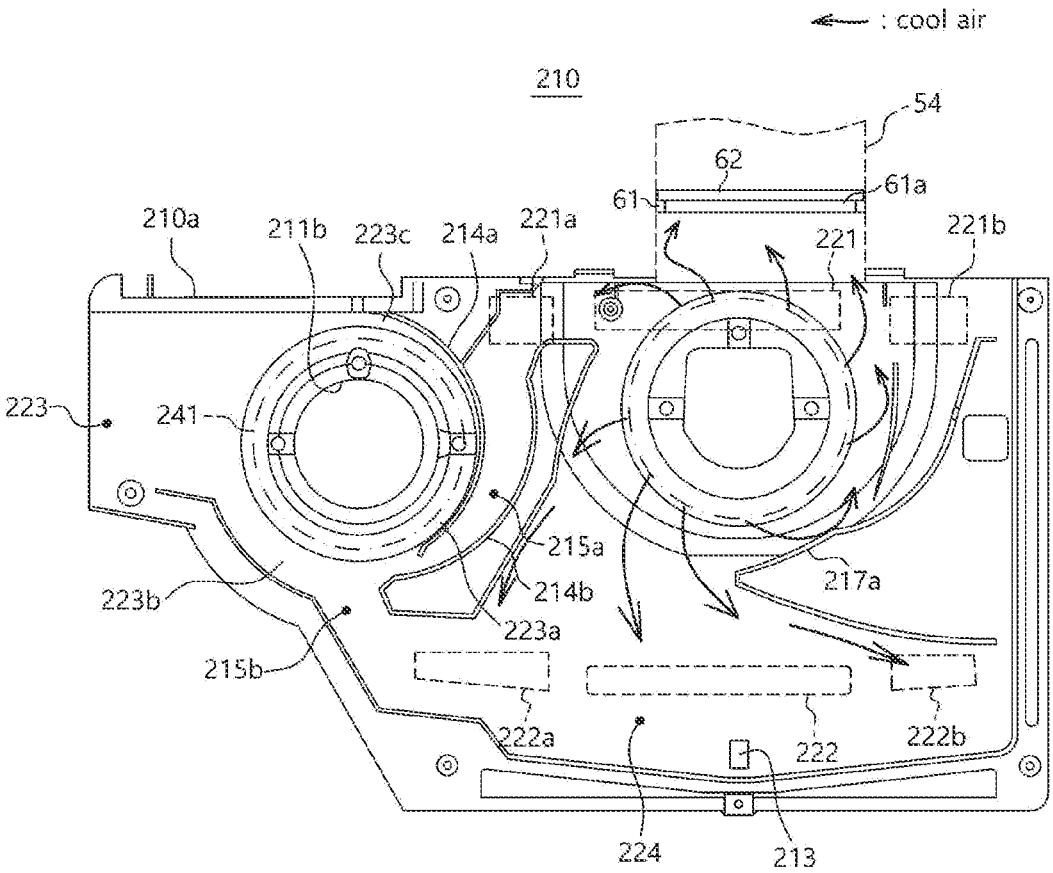
FIG. 27 is a state view viewed from the front side of the shroud, the view showing a flow of cool air when the temperature in the freezing compartment of the refrigerator according to the embodiment of the present disclosure is controlled.
Figure 28:
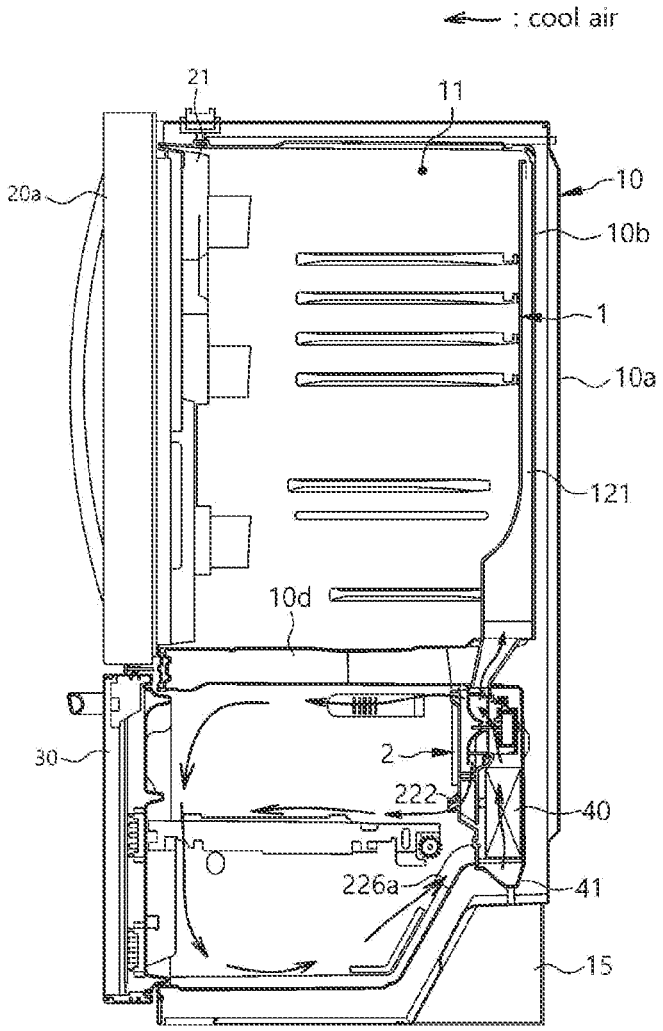
FIG. 28 is a side section view of the refrigerator, the view showing a flow of cool air when the temperature in the freezing compartment of the refrigerator according to the embodiment of the present disclosure is controlled.

Hereinbelow, the process of controlling the temperature of the freezing compartment 12 will be described with reference to FIGS. 27 and 28.

The temperature control of the freezing compartment 12 is performed by the operations of the freezing fan module 230 and the compressor (not shown). That is, when the freezing fan 231 rotates and the compressor is operated by power supply to the freezing fan module 230, the heat exchange of the evaporator 40 is performed, and thus the operation for the temperature control of the freezing compartment 12 is performed. The passage opening and closing module 60 is operated to block between the connection passage 54 and the cool air passage 121 for the refrigerating compartment.

When the freezing fan 231 of the freezing fan module 230 is operated, air in the freezing compartment 12 flows to pass through the evaporator 40 the air blowing force of the freezing fan 231, thereby passing through the evaporator 40 and being heat-exchanged.

The heat exchanged air (cool air) passes through the first inlet hole 211*a* of the shroud 210 and then flows into the cool air passage 224 for the freezing compartment.

In the cool air flowing into the cool air passage 224 for the freezing compartment, cool air blown while rotating along the upper circumference of the freezing fan 231 by the operation of the freezing fan 231 flows into a portion where the cool air outlet 221 for an upper space of the grille panel 220 and the two first auxiliary cool air outlets 221*a* and 221*b* are located. Then, the cool air is discharged to the upper space in the freezing compartment 12 through the outlet 221, 221*a*, and 221*b*.

In particular, by the first circumferential passage rib 214*a*, the cool air blown while rotating along the upper circumference of the freezing fan 231 is sufficiently supplied toward the first auxiliary cool air outlets 221*a* and 221*b* at the side where the ice-making fan 241 is located. Therefore, the cool air may be sufficiently supplied not only to the center of the upper space in the freezing compartment 12, but also to the opposite sides of the center thereof.

In addition, in the cool air flowing into the cool air passage 224 for the freezing compartment, the cool air blown while rotating along the lower circumference of the freezing fan 231 by the operation of the freezing fan 231 flows along a lower wall surface (a bottom surface) 224*b* in the cool air passage 224 for the freezing compartment and is discharged to the middle space in the freezing compartment 12 through the cool air outlet 222 for a middle space of the grille panel 220 and the two second auxiliary cool air outlets 222*a* and 222*b*.

The cool air that passes through each cool air outlet 221, 221*a*, 221*b*, 222, 222*a*, 222*b* and is supplied to the upper and middle sides in the freezing compartment 12 flows in the freezing compartment 12 and then is recovered to the air outlet side of the evaporator 40 by guidance of the suction guides 226*a* and 226*b* formed in the grille panel 220. The recovered cool air repeats the circulation of passing through the evaporator 40 and then flowing into the freezing compartment side grille fan assembly 2, and being supplied into the freezing compartment 12.

Meanwhile, during the temperature control of the freezing compartment 12, the ice-making fan 241 may also be operated.

That is, in the case of the ice-making operation, the ice-making fan 241 is set to be always operated except for special conditions (e.g., when ice is in full in the ice-making compartment). Considering the above state, the ice-making operation may be continuously performed during the freezing operation.

However, when the ice-making operation is performed when the freezing operation is performed, the flow of cool air flowing through the second inlet hole 211*b* and the cool air passage 223 for the ice-making compartment in order is generated by the operation of the ice-making fan 241.

In particular, part of the cool air generated by the operation of the ice-making fan 241 is supplied into the cool air passage 224 for the freezing compartment through the upper shared passage 215*a*. The remaining cool air is supplied into the ice-making compartment 21 through the cool air duct 51 for the ice-making compartment connected to the cool air passage 223 for the ice-making compartment.

That is, cool air passing through the second inlet hole 211*b* and blown to the first area 223*a* of the cool air passage 223 for the ice-making compartment passes through the upper shared passage 215*a* to be supplied to the upper space in the cool air passage 224 for the freezing compartment. Cool air passing through the second inlet hole 211*b* and blown to the second area 223*b* of the cool air passage 223 for the ice-making compartment passes through the lower supply passage 215*b* to be supplied to the lower space in the cool air passage 224 for the freezing compartment. Cool air passing through the second inlet hole 211*b* and blown to the third area 223*c* of the cool air passage 223 for the ice-making compartment is supplied to the ice-making compartment 21 through the cool air duct 51 for the ice-making compartment connected to the cool air outlet side of the cool air passage 223 for the ice-making compartment.

Figure 29:
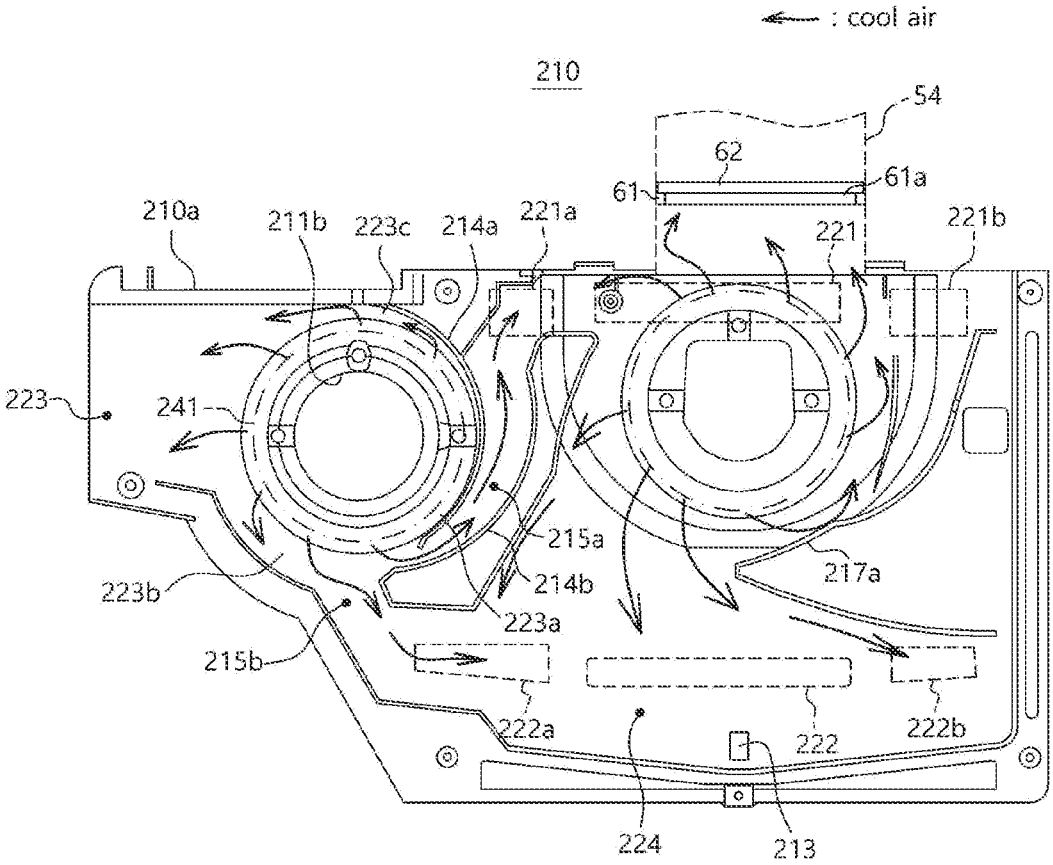
FIG. 29 is a state view viewed from the front side of the shroud, the view showing flows of cool air when the freezing compartment and the ice-making compartment of the refrigerator according to the embodiment of the present disclosure are operated at the same time.

Therefore, in the freezing compartment 12, not only the cool air blown by the operation of the freezing fan 231 but also the cool air blown by the operation of the ice-making fan 241 are supplied, so that sufficient cool air may be supplied. The above structure is as shown in FIG. 29.

In particular, cool air supplied to the cool air passage 223 for the ice-making compartment through the upper supply passage 215*a* is directly discharged to the first auxiliary cool air outlet 221*a* at either side of the freezing compartment 12 in the upper space in the cool air passage 224 for the freezing compartment, so that the cool air is supplied to the freezing compartment 12 through the first auxiliary cool air outlet 221*a* without interfering with the flow of cool air flowing in the cool air passage 223 for the ice-making compartment.

The cool air supplied to the cool air passage 223 for the ice-making compartment through the lower supply passage 215*b* is directly discharged to the second auxiliary cool air outlet 222*a* at either side of the ice-making compartment 21 in the lower space in the cool air passage 223 for the ice-making compartment, so that the cool air is supplied to the freezing compartment 12 through the second auxiliary cool air outlet 222*a* without interfering with the flow of cool air flowing in the cool air passage 223 for the ice-making compartment.

Accordingly, the cool air may be sufficiently supplied to the freezing compartment 12.

Meanwhile, during the refrigerating operation for the refrigerating compartment 11, the ice-making operation for the ice-making compartment 21, or the freezing operation for the freezing compartment 12, condensed water occurs due to temperature difference between portions (the refrigerating compartment 11 and the cool air passage 223 for the ice-making compartment) in the cool air duct 51 for the ice-making compartment. The condensed water is collected in a bottom surface of the cool air passage 223 for the ice-making compartment while flowing along the cool air duct 51 for the ice-making compartment.

However, since the lower supply passage 215*b* is formed in the bottom of the cool air passage 223 for the ice-making compartment, the condensed water flows to the lower wall surface (bottom surface) 224*b* in the cool air passage 223 for the ice-making compartment through the lower supply passage 215*b*, and then is discharged to the outside of the freezing compartment side grille fan assembly 2 through the drainage hole 213 formed in the shroud 210. The discharged condensed water falls into the water spout 41 provided at the lower portion of the evaporator 40.

Accordingly, freezing and malfunction of the ice-making fan 241 due to the condensed water are prevented.

In particular, due to an installation location of the ice-making fan 241, the ice-making fan 241 is directly affected by high temperature (higher temperature than the temperature of the freezing compartment) and humid cool air that is recovered to the freezing compartment 12 through the recovery duct 52 for the ice-making compartment. However, the occurrence of condensed water is prevented by the insulating member 250, even when the condensed water occurs, freezing the ice-making fan 241 is prevented because the condensed water is discharged to the cool air passage 224 for the freezing compartment through the lower supply passage 215*b*.

Figure 30:
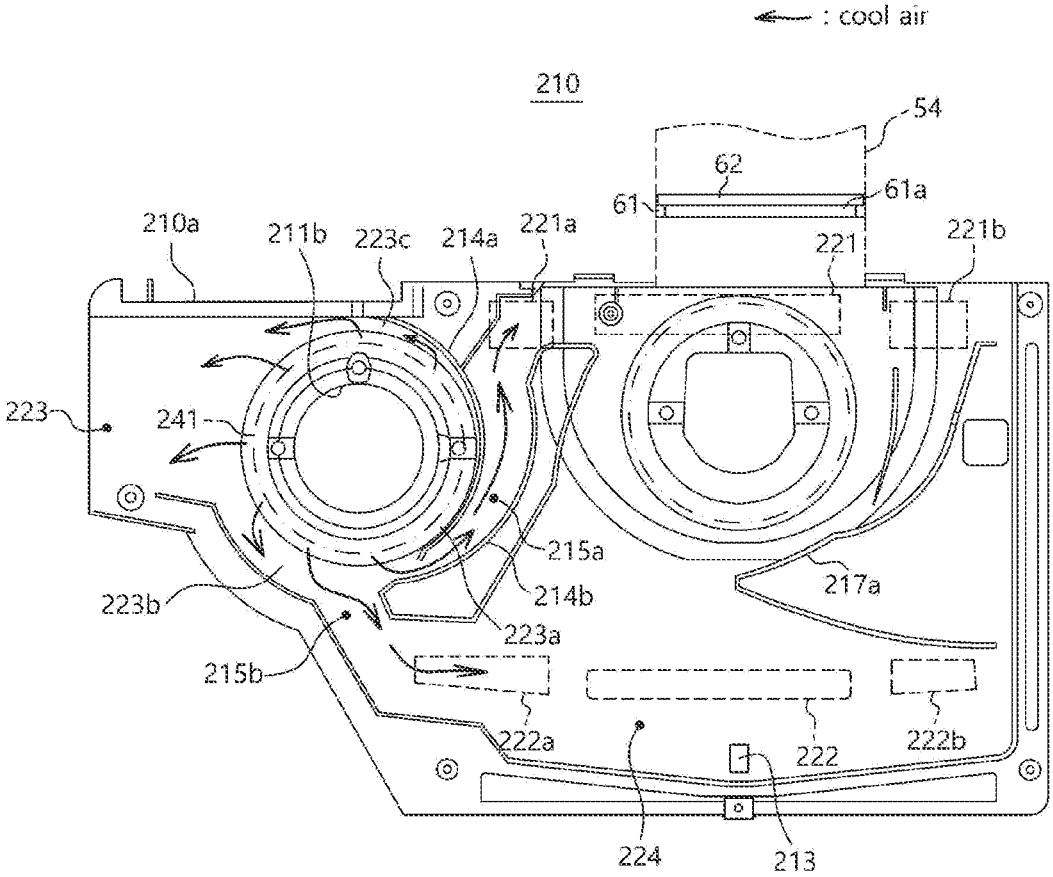
FIG. 30 is a state view from the front side of the shroud, the view showing a flow of cool air when the temperature in the ice-making compartment of the refrigerator according to the embodiment of the present disclosure is controlled.
Figure 31:
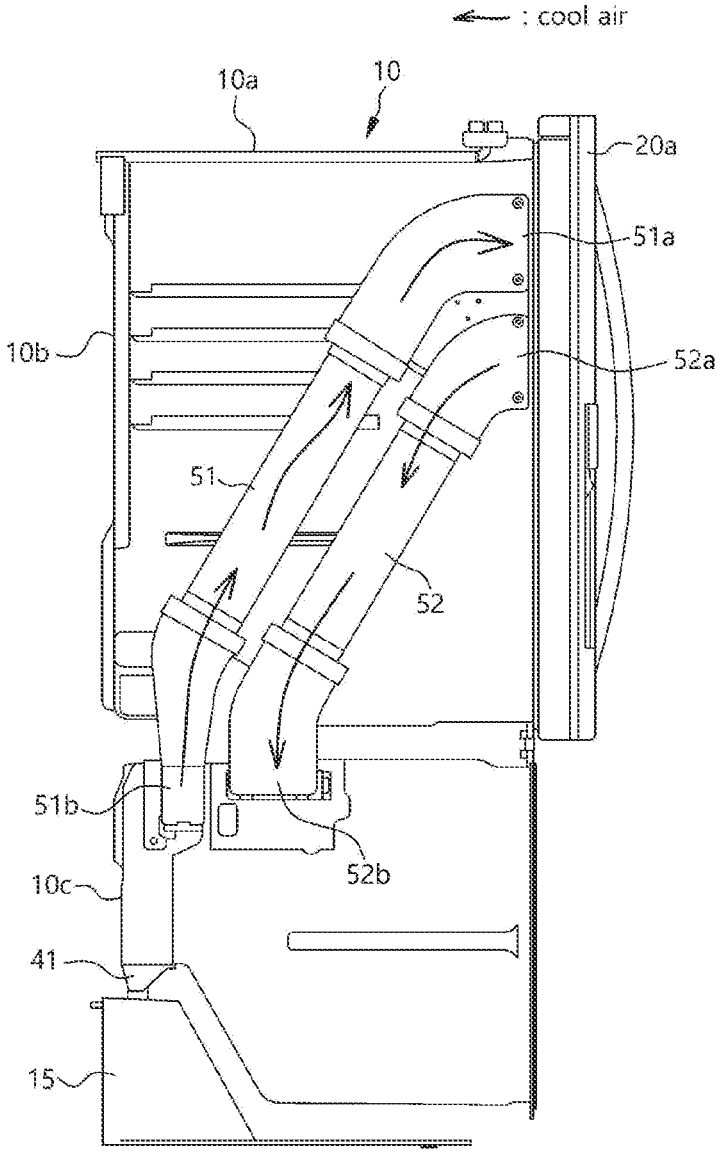
FIG. 31 is a side view of the refrigerator according to the embodiment of the present disclosure, the view showing the flow of cool air when the temperature in the ice-making compartment of the refrigerator is controlled.
Figure 32:
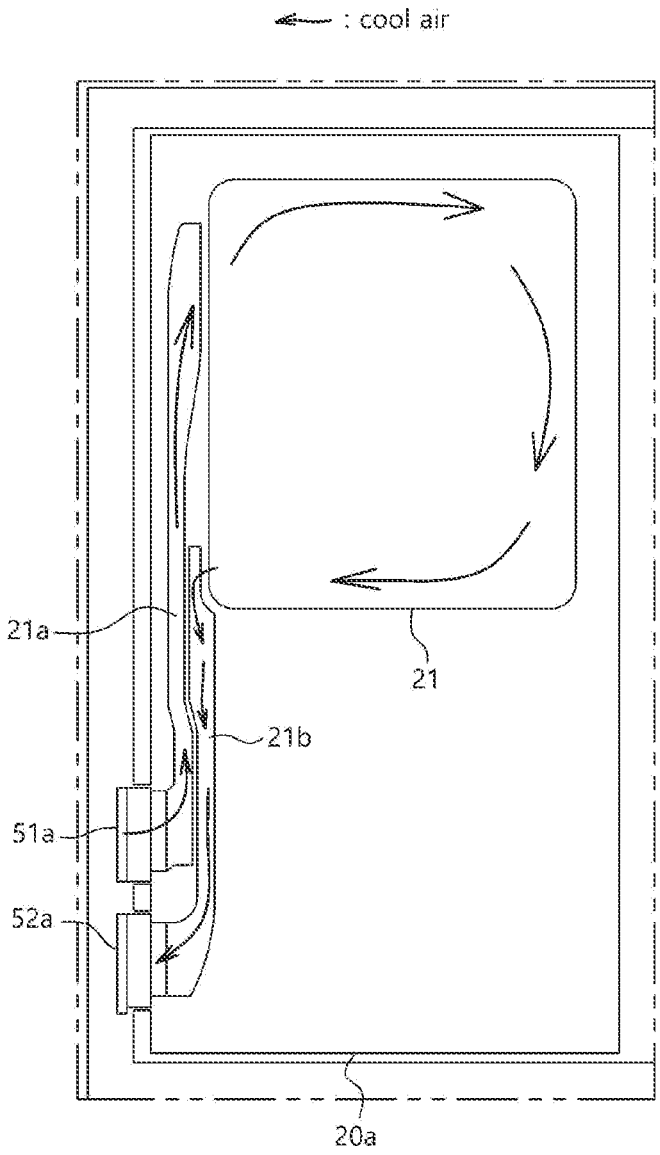
FIG. 32 is a state view schematically showing a flow of cool air in the ice-making compartment when the temperature in the ice-making compartment of the refrigerator according to the embodiment of the present disclosure is controlled.

Hereinbelow, the operation for controlling the temperature in the ice-making compartment 21 (ice-making operation) will be described with reference to FIGS. 30 to 32.

The temperature control of the ice-making compartment 21 is performed by the operation of the ice-making fan 241 due to power supply to the ice-making fan module 240. At this time, the compressor may be operated or stopped in response to the operating conditions of the freezing compartment 12.

When the ice-making fan 241 is operated, air in the freezing compartment 12 passes through the evaporator 40 and passes through the second inlet hole 211*b* of the shroud 210 by the air blowing force of the ice-making fan 241, and then flows into the first area 216*a*, the second area 223*b*, and the third area 223*c* of the cool air passage 223 for the ice-making compartment. Continuously, the air is discharged from the cool air passage 223 for the ice-making compartment through the communication portions with the areas 223*a*, 223*b*, and 223*c*. The above operation is as shown in FIG. 30.

The cool air flowing into the first area 223*a* by the operation of the ice-making fan 241 passes through the upper supply passage 215*a* to be supplied to the upper wall surface 224*a* of the cool air passage 224 for the freezing compartment. The cool air blown to the second area 223*b* is supplied to the lower wall surface 224*b* in the cool air passage 224 for the freezing compartment through the lower supply passage 215*b*. The cool air blown to the third area 223*c* is supplied to the ice-making compartment 21 through the cool air duct 51 for the ice-making compartment.

In addition, the cool air passing through the upper supply passage 215*a* and supplied to the cool air passage 224 for the freezing compartment is supplied to the upper space in the freezing compartment 12 through the first auxiliary cool air outlet 221*a* while being blown toward the first auxiliary cool air outlet 221*a* in the cool air passage 224 for the freezing compartment. The cool air passing through the lower supply passage 215*b* and supplied to the cool air passage 224 for the freezing compartment is supplied to the middle space in the freezing compartment 12 through the second auxiliary cool air outlet 222*a*.

In particular, the cool air passing through the second inlet hole 211*b* and supplied to the cool air passage 223 for the ice-making compartment by the air blowing force of the ice-making fan 241 is discharged to the third area 223*c*, which is the upper portion of the ice-making fan 241, and then the cool air flows along the cool air passage 223 for the ice-making compartment into the cool air outlet side. At this time, since the cool air flows along a sufficient distance from the third area 223*c* to the cool air outlet side, the flow resistance caused by the third area 223*c* and the cool air outlet side adjacent to each other may be reduced.

Accordingly, the inside of the freezing compartment 12 maintains a pressure state similar to a pressure state of the cool air passage 223 for the ice-making compartment by the cool air supplied through the upper shared passage 215*a* and the lower supply passage 215*b*. That is, since the pressures of the freezing compartment 12 and the ice-making compartment 21 are roughly balanced, even when only the ice-making fan 241 is operated for the ice-making operation, the cool air in the freezing compartment 12 may be prevented from (or, be minimized in) passing through the cool air passage 224 for the freezing compartment and the first inlet hole 211*a* in reverse and flowing into the second inlet hole 211*b* and the cool air passage 223 for the ice-making compartment.

The cool air supplied to the ice-making compartment 21 freezes water (or other beverages) in an ice tray (not shown) while flowing in the ice-making compartment 21.

The cool air flowing in the ice-making compartment 21 flows into the recovery duct 52 for the ice-making compartment, and continuously, the cool air is recovered to the freezing compartment 12 by guidance of the recovery duct 52 for the ice-making compartment.

Then, the cool air recovered to the cool air the freezing compartment 12 is directly suctioned into the first suction guide 226*a* located to be opposite thereto, and recovered to the cool air inlet side of the evaporator 40.

Accordingly, the temperature in the ice-making compartment 21 is controlled by the above-described repeated circulation of air (cool air).

As a result, the refrigerator of the present disclosure provides part of the cool air in the cool air passage 223 for the ice-making compartment to the cool air passage 224 for the freezing compartment by the provision of the supply passage 215*a*, 215*b*. Accordingly, although the single evaporator 40 is provided, even when the freezing fan 231 and the ice-making fan 241 are operated at the same time, sufficient cool air may be supplied to the freezing compartment 12, and when only the ice-making fan 241 is operated, the cool air may be prevented from flowing back from the freezing compartment 12.

Further, the refrigerator of the present disclosure is configured such that the supply passage 215*a*, 215*b* directly faces the auxiliary cool air outlet 221*a*, 222*a*, so that the cool air supplied from the cool air passage 223 for the ice-making compartment through the supply passage 215*a*, 215*b* does not interfere with the flow of cool air flowing in the cool air passage 224 for the freezing compartment.

Further, in the refrigerator of the present disclosure, the lower supply passage 215*b* is provided in the lower surface (the second circumferential passage rib) of the installation portion of the ice-making fan module 240. Accordingly, sufficient cool air may be supplied to the lower space in the freezing compartment 12. Further, the condensed water may be discharged through the lower supply passage 215*b*, so that the ice-making fan 241 may be prevented from freezing.

The refrigerator of the present disclosure is configured to supply cool air to the cool air passage 121 for the refrigerating compartment of the refrigerating compartment side grille fan assembly 1 through the cool air outlet 224*e* formed in the upper wall surface 224*a* of the cool air passage 224 for the freezing compartment and the connection passage 54 connected to the cool air outlet 224*e*. Accordingly, selective supply of cool air with respect to the refrigerating compartment 11, the freezing compartment 12, and the ice-making compartment 21 may be performed by the single evaporator 40.

Meanwhile, the refrigerator of the present disclosure is not limited to the structure of the above-described embodiment.

Figure 33:
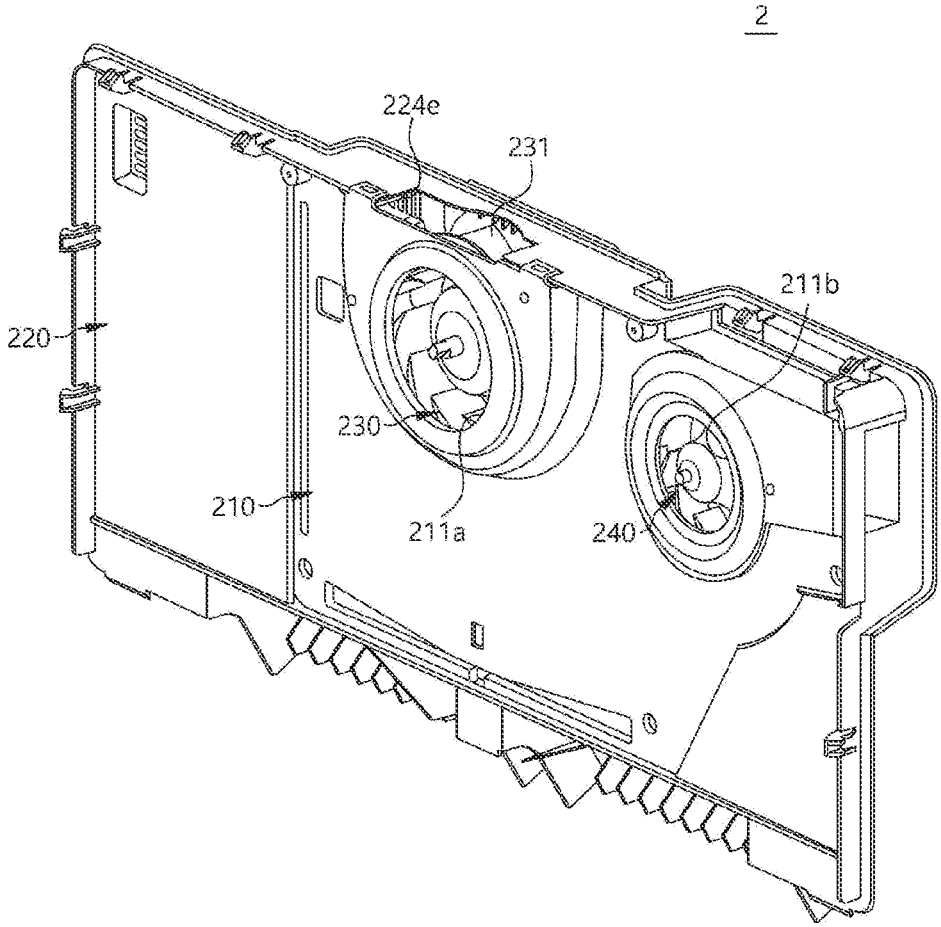
FIGS. 33 to 35 are state views, the state views showing various application examples with respect to the fan modules of the refrigerator according to the embodiment of the present disclosure.
Figure 34:
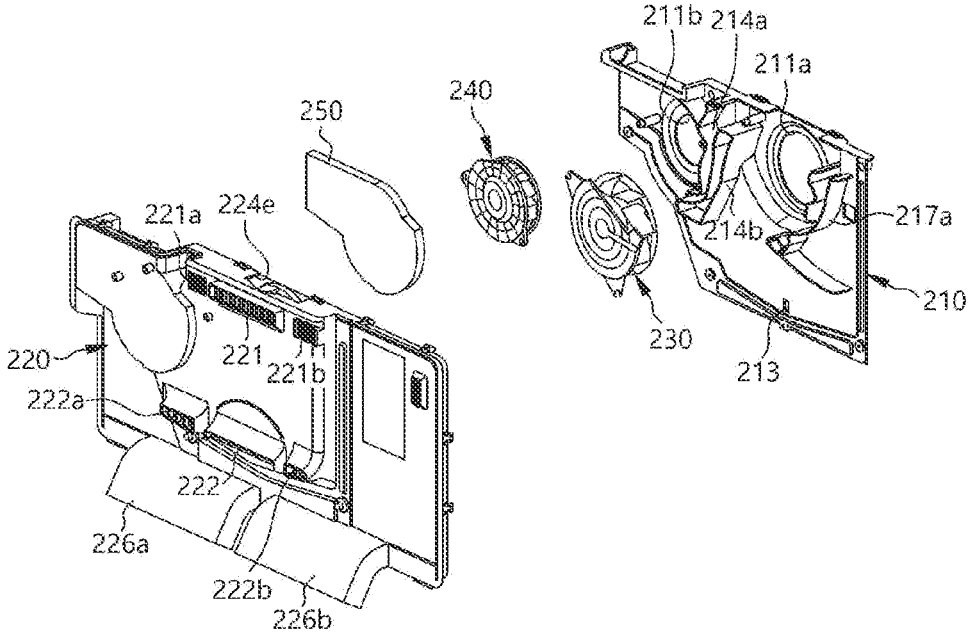
Figure 35:
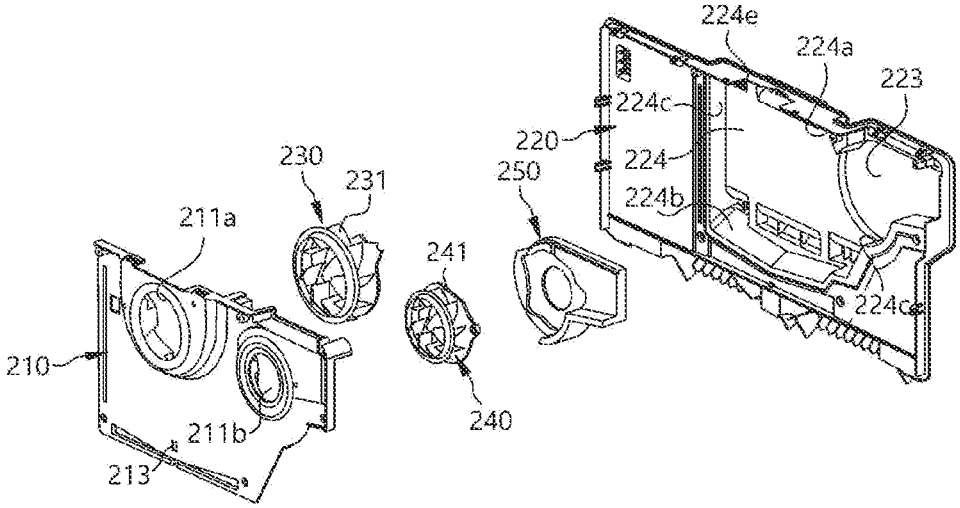

For example, the freezing fan module 230 and the ice-making fan module 240 of the freezing compartment side grille fan assembly 2 may be configured of slim centrifugal fans in which the inside of a hub of each of the freezing fan 231 and the ice-making fan 241 has a motor, and the structure is as shown in FIGS. 33 to 35.

That is, the thickness of the refrigerator may be reduced or additional capacity of the freezing compartment 12 may be secured by a distance in which of the freezing compartment side grille fan assembly 2 protrudes rearward due to the fan motor 232, 242.

As described above, various types of fans may be changed to be used as the fan module 230, 240 constituting the refrigerator of the present disclosure.

The invention claimed is:

1. A refrigerator comprising:

a cabinet having a refrigerating compartment and a freezing compartment, the freezing compartment being located below the refrigerating compartment;

a refrigerating compartment door having an ice-making compartment;

an evaporator located at the freezing compartment and configured to cool air; and a freezing compartment side grille fan assembly that is located at a front of the evaporator, the freezing compartment side grille fan assembly comprising:

a freezing fan and an ice-making fan, a shroud that defines a rear wall surface of the freezing compartment side grille fan assembly and supports the freezing fan and the ice-making fan, and a grille panel that defines a front wall surface of the freezing compartment side grille fan assembly, the grille panel comprising an insulating member configured to suppress condensation from the ice-making fan, wherein the freezing compartment side grille fan assembly includes:

a first cool air passage configured to guide air blown by the freezing fan toward the freezing compartment, a second cool air passage configured to guide air blown by the ice-making fan toward the ice-making compartment, and a plurality of freezing compartment side cool air outlets defined at the front wall surface of the freezing compartment side grille fan assembly and configured to discharge the air guided along the first cool air passage to the freezing compartment, wherein the freezing compartment side grille fan assembly further comprises a passage rib that divides the first cool air passage and the second cool air passage from each other, and wherein the passage rib comprises:

a first circumferential passage rib that extends downward from an upper surface of the freezing compartment side grille fan assembly and is located between the freezing fan and the ice-making fan, the first circumferential passage rib having a round shape surrounding an upper circumference of the ice-making fan, and a second circumferential passage rib that is located between the first circumferential passage rib and the freezing fan and has a round shape surrounding a lower circumference of the first circumferential passage rib.

2. The refrigerator of claim 1, wherein the first cool air passage and the second cool air passage are defined at at least one of a first surface of the grille panel or a second surface of the shroud facing the first surface of the grille panel.

3. The refrigerator of claim 1, wherein the insulating member covers a grille panel side of the second cool air passage.

4. The refrigerator of claim 1, further comprising:

a cool air duct configured to guide air from the freezing compartment side grille fan assembly to the ice-making compartment; and a recovery duct configured to guide air from the ice-making compartment to the freezing compartment.

5. The refrigerator of claim 4, wherein the cool air duct has an end that passes through a wall surface of the freezing compartment side grille fan assembly and is connected to the second cool air passage, the wall surface being positioned at a side of the freezing compartment side grille fan assembly adjacent to the ice-making fan.

6. The refrigerator of claim 4, wherein the recovery duct has an end that passes through a wall surface of the freezing compartment side grille fan assembly and is positioned at a side of the freezing compartment side grille fan assembly adjacent to the ice-making fan.

7. The refrigerator of claim 4, wherein the cool air duct has a cool air outlet, and wherein the recovery duct has an cool air inlet defined at a position forward relative to the cool air outlet of the cool air duct.

8. The refrigerator of claim 1, wherein the freezing fan is located at a center portion of the freezing compartment side grille fan assembly, and the ice-making fan is located at one side of the freezing fan, wherein the first cool air passage is configured to guide the air blown by the freezing fan along a circumference of the freezing fan, wherein the second cool air passage is configured to guide the air blown by the ice-making fan along a circumference of the ice-making fan, and wherein the freezing compartment side grille fan assembly further defines an upper supply passage that is in fluid communication with an upper space of the first cool air passage and configured to supply a part of the air guided along the second cool air passage toward one of the plurality of freezing compartment side cool air outlets.

9. The refrigerator of claim 8, wherein the second cool air passage passes through a wall surface of the freezing compartment side grille fan assembly, the wall surface being positioned at a side adjacent to the ice-making fan among opposite sides of the freezing compartment side grille fan assembly with respect to the freezing fan.

10. The refrigerator of claim 1, wherein an upper end of the second circumferential passage rib is located above a center height of the freezing fan.

11. The refrigerator of claim 1, wherein the freezing compartment side grille fan assembly further defines an upper supply passage that is in fluid communication with an upper space of the first cool air passage and configured to supply a part of the air guided along the second cool air passage toward one of the plurality of freezing compartment side cool air outlets, wherein the second circumferential passage rib is spaced apart from the first circumferential passage rib, and wherein the upper supply passage includes a space defined between the first circumferential passage rib and the second circumferential passage rib, the upper supply passage being opened in a vertical direction.

12. The refrigerator of claim 11, wherein the upper supply passage has an open upper portion that faces one of the plurality of freezing compartment side cool air outlets.

13. The refrigerator of claim 11, wherein the second circumferential passage rib comprises a wall surface that extends toward an upper end of the second circumferential passage rib and faces the freezing fan, the wall surface being inclined with respect to the vertical direction or rounded toward the freezing fan.

14. The refrigerator of claim 1, wherein the freezing compartment side grille fan assembly further defines a lower supply passage that is in fluid communication with a lower space of the first cool air passage and configured to supply a part of the air guided along the second cool air passage toward one of the plurality of freezing compartment side cool air outlets.

15. The refrigerator of claim 14, wherein the grille panel defines a recessed portion that defines the first cool air passage and the second cool air passage at a rear surface of the grille panel, and wherein the lower supply passage is configured to discharge air toward one side among opposite sides of the recessed portion of the rear surface of the grille panel.

16. The refrigerator of claim 1, further comprising a recovery duct located at the cabinet and configured to guide air from the refrigerating compartment to a cool air inlet side of the evaporator.

17. The refrigerator of claim 16, wherein the recovery duct is located at a rear side of the cabinet, the recovery duct having:

a first end connected to a lower end of a rear surface of the refrigerating compartment; and a second end connected to the cool air inlet side of the evaporator and located at a rear surface of the freezing compartment.

18. A refrigerator comprising:

a cabinet having a refrigerating compartment and a freezing compartment, the freezing compartment being located below the refrigerating compartment;

a refrigerating compartment door having an ice-making compartment;

an evaporator located at the freezing compartment and configured to cool air; and a freezing compartment side grille fan assembly that is located at a front of the evaporator, the freezing compartment side grille fan assembly comprising:

a freezing fan and an ice-making fan, a shroud that defines a rear wall surface of the freezing compartment side grille fan assembly and supports the freezing fan and the ice-making fan, and a grille panel that defines a front wall surface of the freezing compartment side grille fan assembly, the grille panel comprising an insulating member configured to suppress condensation from the ice-making fan, wherein the freezing compartment side grille fan assembly includes:

a first cool air passage configured to guide air blown by the freezing fan toward the freezing compartment, a second cool air passage configured to guide air blown by the ice-making fan toward the ice-making compartment, and a plurality of freezing compartment side cool air outlets defined at the front wall surface of the freezing compartment side grille fan assembly and configured to discharge the air guided along the first cool air passage to the freezing compartment, wherein the grille panel defines a recessed portion that defines the first cool air passage and the second cool air passage at a rear surface of the grille panel, and wherein the grille panel has a lower wall surface located in the recessed portion and inclined downward toward a center portion of the lower wall surface, and wherein the shroud defines a drainage hole that is in fluid communication with the center portion of the lower wall surface of the grille panel.

* * * * *